US007997861B2

(12) United States Patent
Hudson et al.

(10) Patent No.: US 7,997,861 B2
(45) Date of Patent: Aug. 16, 2011

(54) AIRFOIL SHAPE FOR A COMPRESSOR

(75) Inventors: Michael T. Hudson, Greenville, SC (US); Marc E. Blohm, Greenville, SC (US)

(73) Assignee: General Electric Company, Schenectady, NY (US)

( * ) Notice: Subject to any disclaimer, the term of this patent is extended or adjusted under 35 U.S.C. 154(b) by 565 days.

(21) Appl. No.: 12/249,119

(22) Filed: Oct. 10, 2008

(65) Prior Publication Data

US 2010/0092298 A1 Apr. 15, 2010

(51) Int. Cl.
*F04D 29/44* (2006.01)

(52) U.S. Cl. ..... 415/191; 415/189; 415/190

(58) Field of Classification Search ..... 415/191
See application file for complete search history.

(56) References Cited

U.S. PATENT DOCUMENTS 7,648,334 B2 * 1/2010 Hurst et al. ..... 415/115
2010/0158678 A1 * 6/2010 Bielek et al. ..... 415/193

* cited by examiner

*Primary Examiner* — Matthew Landau
*Assistant Examiner* — Robert Bachner
(74) *Attorney, Agent, or Firm* — Ernest G. Cusick; Frank A. Landgraff

(57) ABSTRACT

An article of manufacture having a nominal profile substantially in accordance with Cartesian coordinate values of X, Y and Z set forth in TABLE 1. X and Y are distances in inches which, when connected by smooth continuing arcs, define airfoil profile sections at each distance Z in inches. The profile sections at the Z distances are joined smoothly with one another to form a complete airfoil shape.

8 Claims, 5 Drawing Sheets

AIRFOIL SHAPE FOR A COMPRESSOR

BACKGROUND OF THE INVENTION

The present invention relates to airfoils for a stator compressor vane of turbo machinery. In particular, the invention relates to compressor airfoil profiles for various stages of the compressor. In particular, the invention relates to a stator compressor vane airfoil profile, such as but not limited to, profiles for stator vanes, rotors, inlet guide vanes or the like. Also, in particular, the invention relates to compressor airfoil profiles for a "Stage 14" stator vane.

In a gas turbine, many system requirements should be met at each stage of a gas turbine's flow path section to meet design goals. These design goals include, but are not limited to, overall improved efficiency and airfoil loading capability. For example, and in no way limiting of the invention, a stator compressor vane should achieve thermal and mechanical operating requirements for that particular stage. Further, for example, and in no way limiting of the invention, a blade of a stator compressor vane should achieve thermal and mechanical operating requirements for that particular stage.

BRIEF DESCRIPTION OF THE INVENTION

In accordance with one embodiment of the instant invention, there is provided an airfoil shape for a stator compressor vane. The airfoil shape hereof also improves the interaction between various stages of the compressor and affords improved aerodynamic efficiency, while simultaneously reducing fourteenth stage airfoil thermal and mechanical stresses.

The stator compressor vane airfoil profile, as embodied by the invention, is defined by a unique loci of points to achieve the necessary efficiency and loading requirements whereby improved compressor performance is obtained. These unique loci of points define the nominal airfoil profile and are identified by the X, Y and Z Cartesian coordinates of TABLE 1 that follows. The points for the coordinate values shown in TABLE 1 are relative to the a point "O", a manufacturing datum at the intersection of the root portion of the airfoil and the platform, and for a cold, i.e., room temperature blade at various cross-sections of the airfoil along its length. The positive X, Y and Z directions are axial toward the exhaust end of the turbine, tangential in the direction of engine rotation and radially outwardly toward the static case, respectively. The X, Y, and Z coordinates are given in distance dimensions, e.g., units of inches, and are joined smoothly at each Z location to form a smooth continuous airfoil cross-section. Each defined airfoil section in the X, Y plane is joined smoothly with adjacent airfoil sections in the Z direction to form the complete airfoil shape.

It will be appreciated that an airfoil heats up during use, as known in the art. The airfoil profile will thus change as a result of mechanical loading and temperature. Accordingly, the cold or room temperature profile, for manufacturing purposes, is given by X, Y and Z coordinates. A distance of plus or minus about 0.160 inches from the nominal profile in a direction normal to any surface location along the nominal profile and which includes any coating, defines a profile envelope for this compressor vane airfoil, because a manufactured stator compressor vane airfoil profile may be different from the nominal airfoil profile given by the following TABLE 1. The airfoil shape is robust to this variation, without impairment of the mechanical and aerodynamic functions of the blade.

The airfoil, as embodied by the invention, can be scaled up or scaled down geometrically for introduction into similar turbine designs. Consequently, the X, Y and Z coordinates of the nominal airfoil profile may be a function of a constant. That is, the X, Y and Z coordinate values may be multiplied or divided by the same constant or number to provide a "scaled-up" or "scaled-down" version of the stator compressor vane airfoil profile, while retaining the airfoil section shape, as embodied by the invention.

In one embodiment of the invention, a stator compressor vane comprises an airfoil having an airfoil shape, the airfoil having a nominal profile substantially in accordance with Cartesian coordinate values of X, Y and Z set forth in TABLE 1. X and Y are distances which, when connected by smooth continuing arcs, define airfoil profile sections at each distance Z in inches. The profile sections at the Z distances are joined smoothly with one another to form a complete airfoil shape.

In another embodiment according to the invention, a stator compressor vane includes a stator compressor vane airfoil having an uncoated nominal airfoil profile substantially in accordance with Cartesian coordinate values of X, Y and Z set forth in. X and Y are distances in inches which, when connected by smooth continuing arcs, define airfoil profile sections at each Z distance in inches. The profile sections at the Z distances are joined smoothly with one another to form a complete airfoil shape. X and Y distances are scalable as a function of a constant to provide a scaled-up or scaled-down airfoil.

In a further embodiment of the invention, a compressor comprises a compressor case having a plurality of stator compressor vanes. Each of the stator compressor vane includes an airfoil having an airfoil shape. The airfoil comprises a nominal profile substantially in accordance with Cartesian coordinate values of X, Y and Z set forth in of TABLE 1. X and Y are distances in inches which, when connected by smooth continuing arcs, define the airfoil profile sections at each distance Z in inches. The profile sections at the Z distances are joined smoothly with one another to form a complete airfoil shape.

In a yet further embodiment of the invention, a compressor comprises a compressor case having a plurality of stator compressor vanes, and each of the stator compressor vanes include an airfoil having an uncoated nominal airfoil profile substantially in accordance with Cartesian coordinate values of X, Y and Z set forth in TABLE 1. X and Y are distances which, when connected by smooth continuing arcs, define airfoil profile sections at each distance Z in inches. The profile sections at the Z distances are joined smoothly with one another to form a complete airfoil shape. The X, Y and Z distances are scalable as a function of a constant to provide a scaled-up or scaled-down stator compressor vane airfoil.

DETAILED DESCRIPTION OF THE INVENTION

Figure 1:
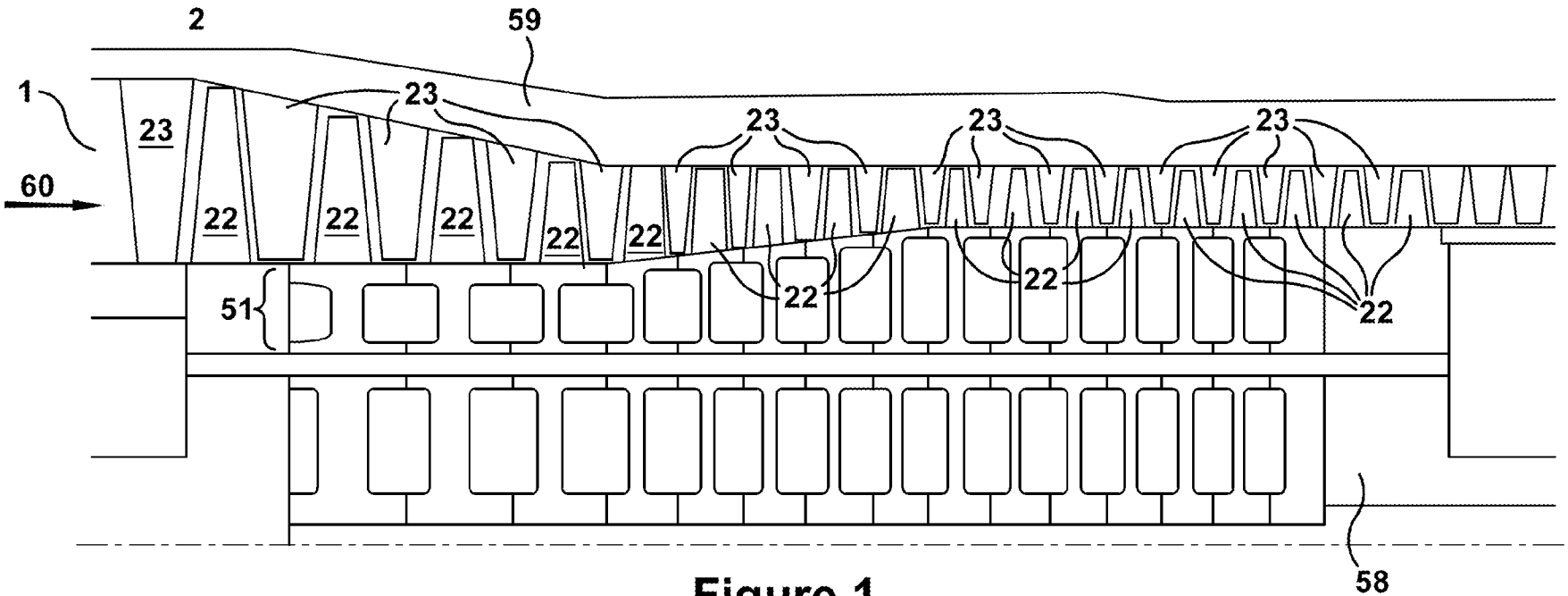
FIG. 1 is a schematic representation of a compressor flow path through multiple stages of a gas turbine and illustrates an exemplary stator compressor vane according to an embodiment of the invention.
Figure 4:
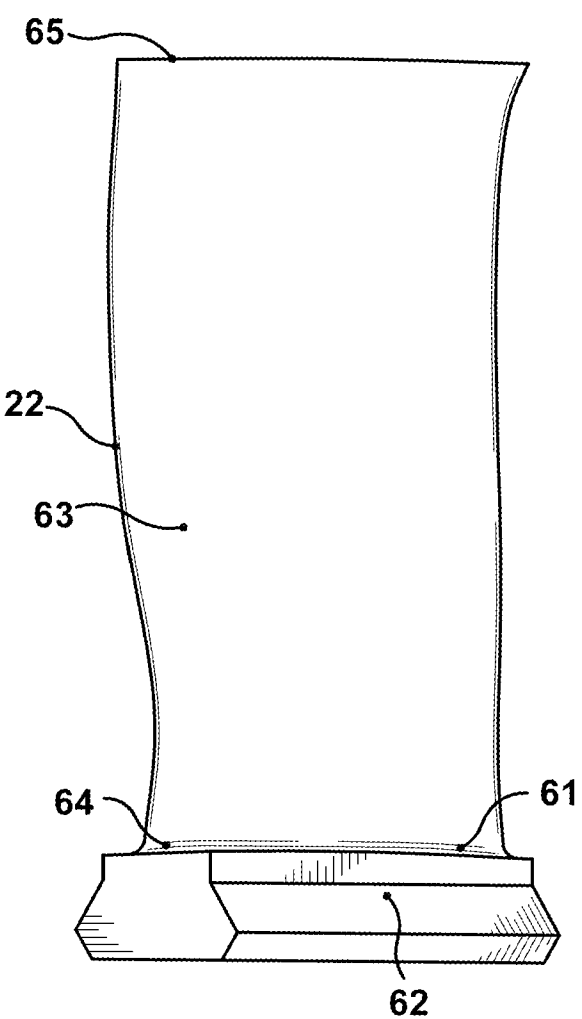
FIGS. 4 and 5 are side elevational views of the stator compressor vane of FIG. 2 and associated platform and dovetail connection as viewed in a generally circumferential direction from the pressure and suction sides of the airfoil, respectively.
Figure 3:
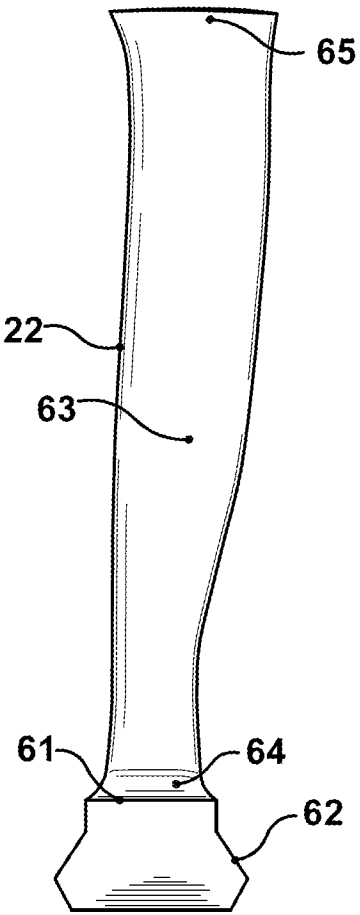
FIGS. 2 and 3 are respective perspective views of a stator compressor vane according to an embodiment of the invention with the stator compressor vane airfoil illustrated in conjunction with its platform and its substantially or near axial entry dovetail connection.
Figure 2:
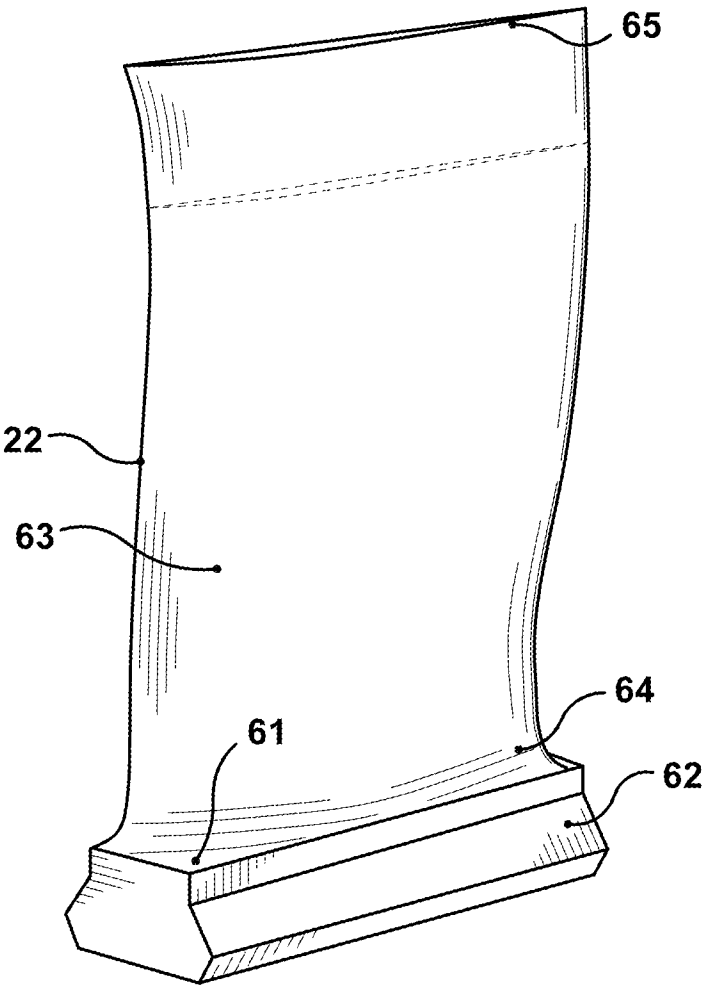

Referring now to the drawings, FIG. 1 illustrates an axial compressor flow path 1 of a gas turbine compressor 2 includes a plurality of compressor stages. The compressor stages are sequentially numbered in FIG. 1. The compressor flow path comprises seventeen rotor and stator stages. However the exact number of rotor and stator stages is a choice of engineering design. Any number of rotor and stator stages can be provided in the combustor, as embodied by the invention. The seventeen rotor stages are merely exemplary of one turbine design. The seventeen rotor stages are not intended to limit the invention in any manner.

The compressor rotor blades and impart kinetic energy to the airflow and therefore bring about a desired pressure rise. Directly following the rotor airfoils is a stage of stator compressor vane airfoils. Both the rotor and stator airfoils turn the airflow, slow the airflow velocity (in the respective airfoil frame of reference), and yield a rise in the static pressure of the airflow. Typically, multiple rows of rotor/stator stages are stacked in axial flow compressors to achieve a desired discharge to inlet pressure ratio. Rotor and stator airfoils can be secured to rotor wheels or stator case by an appropriate attachment configuration, often known as a "root," "base" or "dovetail" (see FIGS. 2-5).

An exemplary stage of the compressor 2 is exemplarily illustrated in FIG. 1. The stage of the compressor 2 comprises a plurality of circumferentially spaced rotor blades 22 mounted on a rotor wheel 51 and a plurality of circumferentially spaced stator blades 23 attached to a static compressor case 59. Each of the rotor wheels is attached to aft drive shaft 58, which is connected to the turbine section of the engine. The rotor blades and stator blades lie in the flow path 1 of the compressor. The direction of airflow through the compressor flow path 1, as embodied by the invention, is indicated by the arrow 60 (FIG. 1). The stator compressor vane herein of the compressor 2 is merely exemplarily of the stages of the compressor 2 within the scope of the invention.

Figure 6:
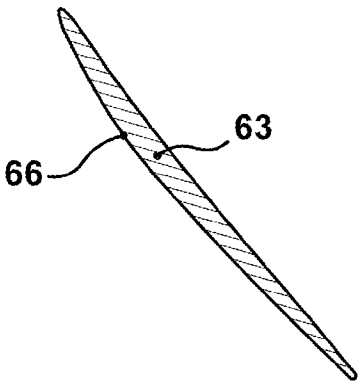
FIG. 6 is a cross-sectional view of the stator compressor vane airfoil taken generally about on line 6-6 in FIG. 5.
Figure 5:
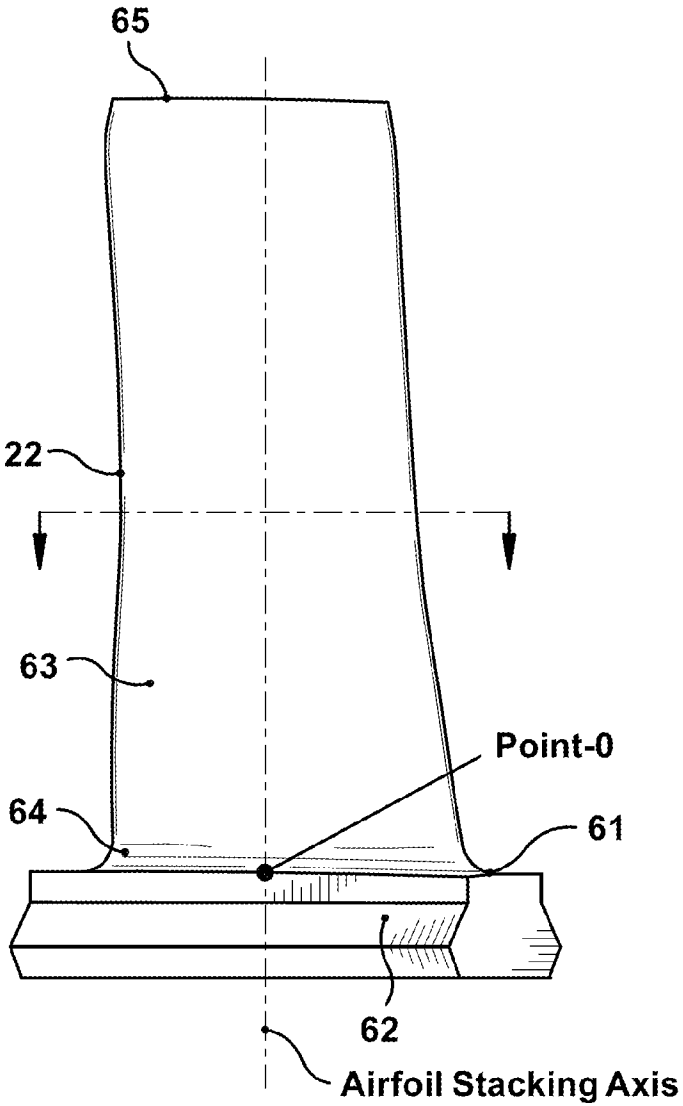
Figure 8:
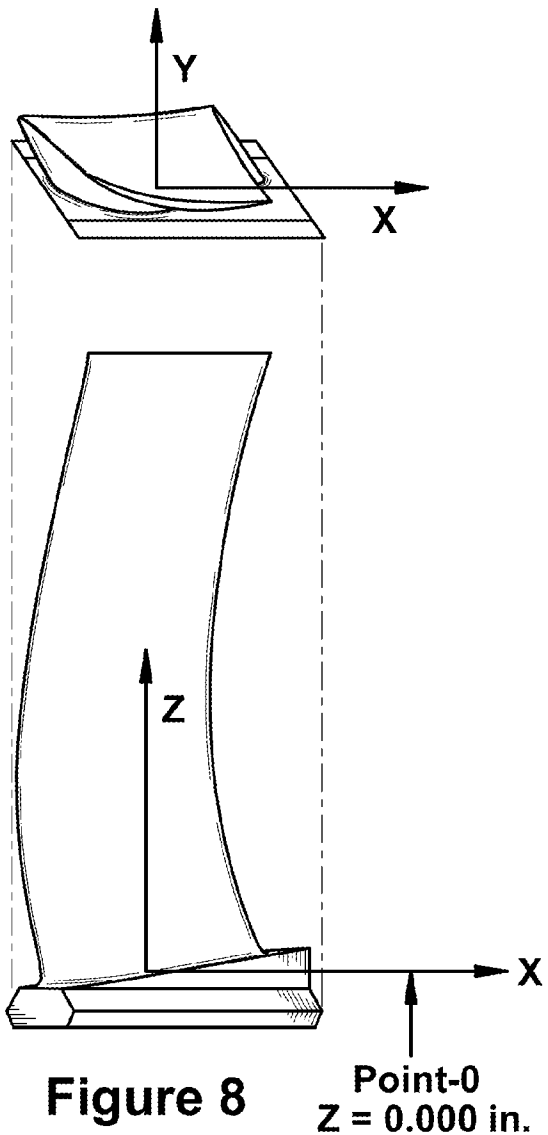
FIGS. 7 and 8 are side views of the stator compressor vane of FIG. 2 and associated platform and dovetail connection as embodied by the invention.
Figure 7:
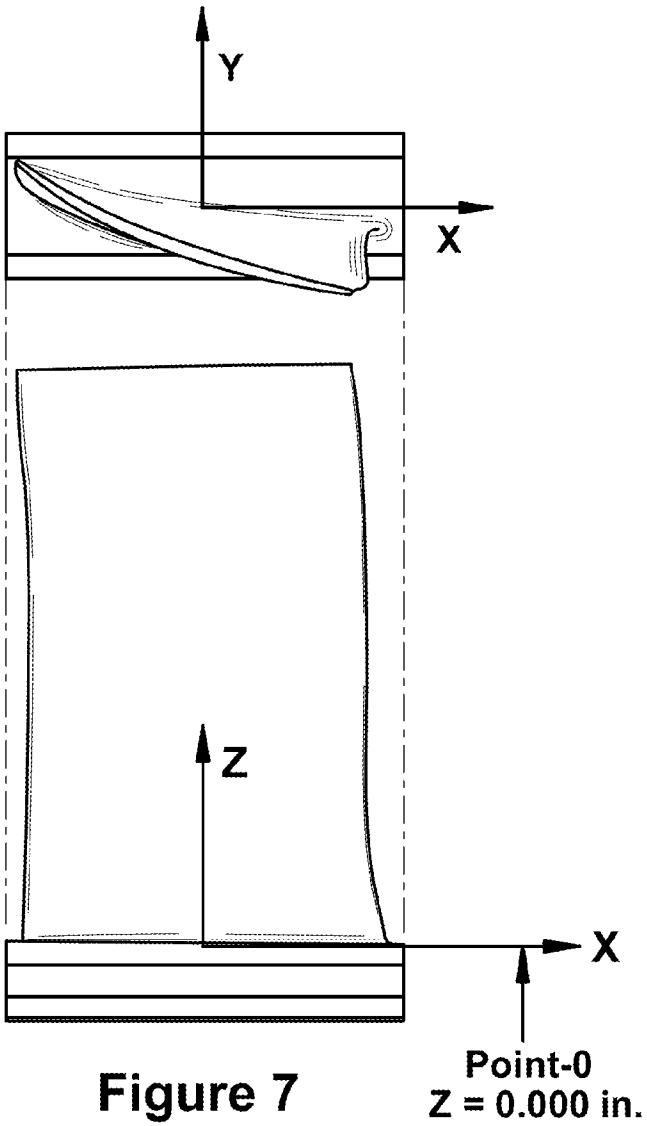

The rotor blades 22 are mounted on the rotor wheel 51 forming part of aft drive shaft 58. Each rotor blade 22, as illustrated in FIGS. 2-6, is provided with a platform 61, and substantially or near axial entry dovetail 62 for connection with a complementary-shaped mating dovetail, not shown, on the rotor wheel 51. An axial entry dovetail, however, may be provided with the airfoil profile, as embodied by the invention. Each rotor blade 22 comprises a rotor blade airfoil 63, as illustrated in FIGS. 2-6. Thus, each of the rotor blades 22 has a rotor blade airfoil profile 66 at any cross-section from the airfoil root 64 at a midpoint of platform 61 to the rotor blade tip 65 in the general shape of an airfoil (FIG. 6).

To define the airfoil shape of the stator compressor vane airfoil, a unique set or loci of points in space are provided. This unique set or loci of points meet the stage requirements so the stage can be manufactured. This unique loci of points also meets the desired requirements for stage efficiency and reduced thermal and mechanical stresses. The loci of points are arrived at by iteration between aerodynamic and mechanical loadings enabling the compressor to run in an efficient, safe and smooth manner.

The loci, as embodied by the invention, defines the stator compressor vane airfoil profile and can comprise a set of points relative to the axis of rotation of the engine. For example, a set of points can be provided to define a stator compressor vane airfoil profile.

A Cartesian coordinate system of X, Y and Z values given in the TABLE 1 below defines a profile of a stator compressor vane airfoil at various locations along its length. The coordinate values for the X, Y and Z coordinates are set forth in inches, although other units of dimensions may be used when the values are appropriately converted. These values exclude fillet regions of the platform. The Cartesian coordinate system has orthogonally-related X, Y and Z axes. The X axis lies parallel to the compressor rotor centerline, such as the rotary axis. A positive X coordinate value is axial toward the aft, for example the exhaust end of the compressor. A positive Y coordinate value directed aft extends tangentially in the direction of rotation of the rotor. A positive Z coordinate value is directed radially outward toward the static casing of the compressor.

By defining X and Y coordinate values at selected locations in a Z direction normal to the X, Y plane, the profile section of the stator compressor vane airfoil, such as, but not limited to the profile section 66 in FIG. 6, at each Z distance along the length of the airfoil can be ascertained. By connecting the X and Y values with smooth continuing arcs, each profile section 66 at each distance Z can be fixed. The airfoil profiles of the various surface locations between the distances Z are determined by smoothly connecting the adjacent profile sections 66 to one another, thus forming the airfoil profile. These values represent the airfoil profiles at ambient, non-operating or non-hot conditions and are for an uncoated airfoil.

Figure 9:
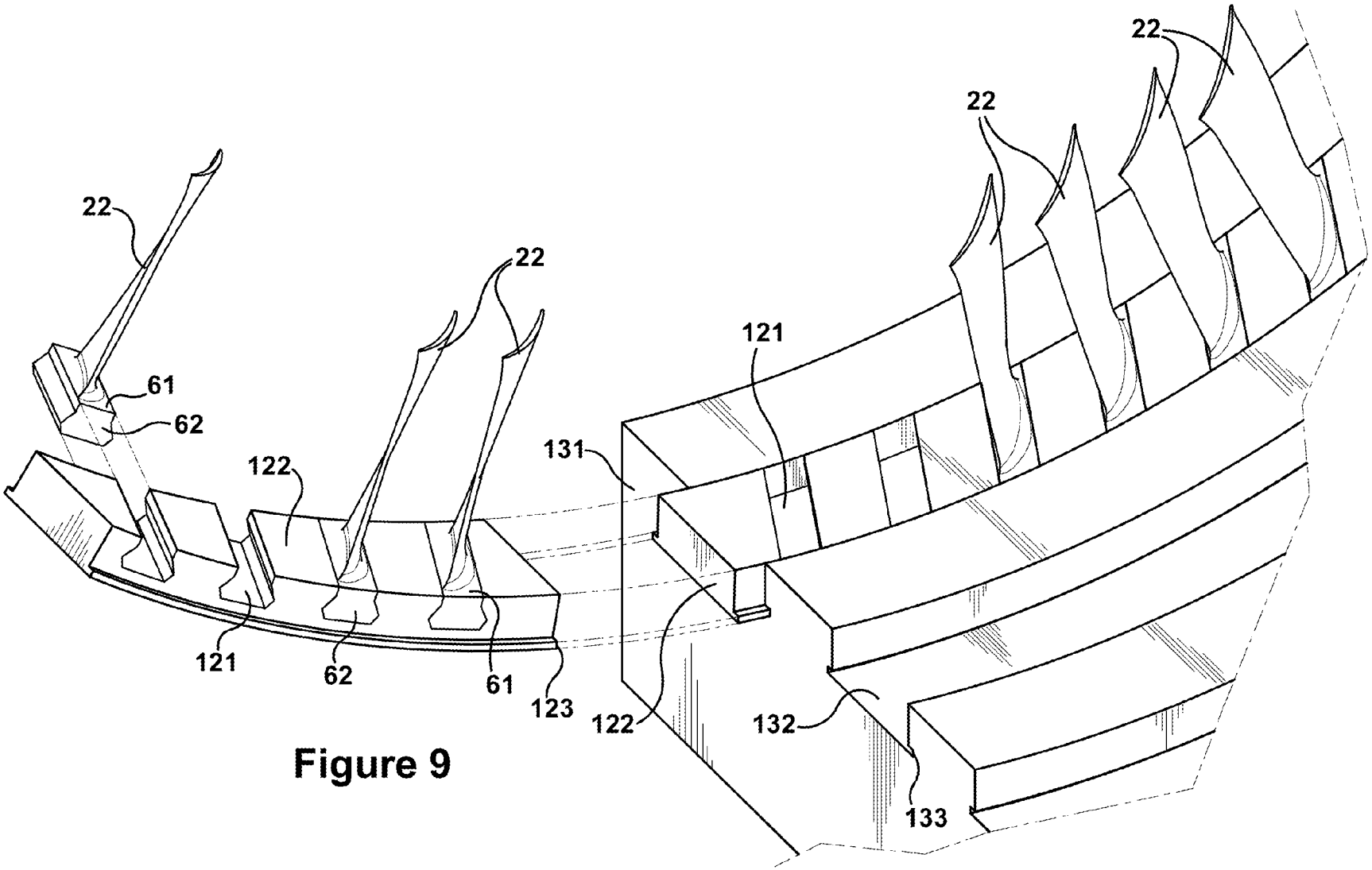
FIG. 9 is a schematic view of a vane, ring, and casing configuration, as embodied by the invention.

The vanes 22, as embodied by the invention, and as illustrated in FIGS. 5 and 7-9, comprise a platform 61 and a dovetail 62 configuration. As in FIG. 9, as embodied by another embodiment of the invention, the vane 22 may be inserted into a cutout 121 of a ring 122. In turn, the ring 122 may be inserted into a slot 132 of a case or casing 131. The ring 122 may comprises a tab 123 that is inserted into slot 133 in the case or casing 131. The arrangement of FIG. 9 provides a stable and secure mounting of the vanes 22 in the overall apparatus.

The TABLE 1 values are generated and shown for determining the profile of the stator compressor vane airfoil. There are typical manufacturing tolerances as well as coatings, which should be accounted for in the actual profile of the airfoil. Accordingly, the values for the profile given are for a nominal airfoil. It will therefore be appreciated that +/− typical manufacturing tolerances, such as, +/− values, including any coating thicknesses, are additive to the X and Y values. Therefore, a distance of about +/−0.160 inches in a direction normal to any surface location along the airfoil profile defines an airfoil profile envelope for a stator compressor vane airfoil design and compressor. In other words, a distance of about +/−0.160 inches in a direction normal to any surface location along the airfoil profile defines a range of variation between measured points on the actual airfoil surface at nominal cold or room temperature and the ideal position of those points, at the same temperature, as embodied by the invention. The stator compressor vane airfoil design, as embodied by the invention, is robust to this range of variation without impairment of mechanical and aerodynamic functions.

The airfoil defined by the coordinate system of X, Y and Z values given in the TABLE 1 below defines a profile of a stator compressor vane or airfoil at various locations along its length. For example, the airfoil defined by the coordinate system of X, Y and Z values given in the TABLE 1 below defines a profile of a Stage 14 stator compressor vane at various locations along its length The coordinate values given in TABLE 1 below provide the nominal profile envelope for an exemplary stage compressor vane.

TABLE 1

| X | Y | Z |
|---|---|---|
| 0.82756 | −0.67139 | 0.00000 |
| 0.82709 | −0.67209 | 0.00000 |
| 0.82606 | −0.67342 | 0.00000 |
| 0.82369 | −0.67579 | 0.00000 |
| 0.81926 | −0.67855 | 0.00000 |
| 0.81010 | −0.68018 | 0.00000 |
| 0.79857 | −0.67595 | 0.00000 |
| 0.78404 | −0.66825 | 0.00000 |
| 0.76589 | −0.65863 | 0.00000 |
| 0.74224 | −0.64620 | 0.00000 |
| 0.71479 | −0.63219 | 0.00000 |
| 0.68531 | −0.61763 | 0.00000 |
| 0.65205 | −0.60144 | 0.00000 |
| 0.61513 | −0.58340 | 0.00000 |
| 0.57463 | −0.56331 | 0.00000 |
| 0.53241 | −0.54208 | 0.00000 |
| 0.48852 | −0.51960 | 0.00000 |
| 0.44304 | −0.49572 | 0.00000 |
| 0.39604 | −0.47032 | 0.00000 |
| 0.34763 | −0.44325 | 0.00000 |
| 0.29790 | −0.41437 | 0.00000 |
| 0.24694 | −0.38350 | 0.00000 |
| 0.19490 | −0.35049 | 0.00000 |
| 0.14366 | −0.31635 | 0.00000 |
| 0.09329 | −0.28100 | 0.00000 |
| 0.04386 | −0.24437 | 0.00000 |
| −0.00458 | −0.20635 | 0.00000 |
| −0.05185 | −0.16679 | 0.00000 |
| −0.09759 | −0.12580 | 0.00000 |
| −0.14182 | −0.08356 | 0.00000 |
| −0.18464 | −0.04014 | 0.00000 |
| −0.22609 | 0.00442 | 0.00000 |
| −0.26625 | 0.05006 | 0.00000 |
| −0.30517 | 0.09674 | 0.00000 |
| −0.34161 | 0.14284 | 0.00000 |
| −0.37566 | 0.18830 | 0.00000 |
| −0.40740 | 0.23304 | 0.00000 |
| −0.43693 | 0.27700 | 0.00000 |
| −0.46433 | 0.32010 | 0.00000 |
| −0.48962 | 0.36230 | 0.00000 |
| −0.51273 | 0.40351 | 0.00000 |
| −0.53282 | 0.44162 | 0.00000 |
| −0.55012 | 0.47650 | 0.00000 |
| −0.56450 | 0.50822 | 0.00000 |
| −0.57613 | 0.53671 | 0.00000 |
| −0.58544 | 0.56176 | 0.00000 |
| −0.59258 | 0.58329 | 0.00000 |
| −0.59788 | 0.60192 | 0.00000 |
| −0.60157 | 0.61774 | 0.00000 |
| −0.60351 | 0.63100 | 0.00000 |
| −0.60355 | 0.64185 | 0.00000 |
| −0.60216 | 0.65007 | 0.00000 |
| −0.60000 | 0.65596 | 0.00000 |
| −0.59732 | 0.66046 | 0.00000 |
| −0.59454 | 0.66358 | 0.00000 |
| −0.59208 | 0.66556 | 0.00000 |
| −0.58953 | 0.66707 | 0.00000 |
| −0.58587 | 0.66854 | 0.00000 |
| −0.58102 | 0.66952 | 0.00000 |
| −0.57514 | 0.66963 | 0.00000 |
| −0.56733 | 0.66838 | 0.00000 |
| −0.55760 | 0.66508 | 0.00000 |
| −0.54620 | 0.65932 | 0.00000 |
| −0.53301 | 0.65107 | 0.00000 |
| −0.51773 | 0.64059 | 0.00000 |
| −0.50030 | 0.62769 | 0.00000 |
| −0.48011 | 0.61191 | 0.00000 |
| −0.45718 | 0.59323 | 0.00000 |
| −0.43171 | 0.57146 | 0.00000 |
| −0.40374 | 0.54655 | 0.00000 |

TABLE 1-continued

| X | Y | Z |
|---|---|---|
| −0.37307 | 0.51875 | 0.00000 |
| −0.33968 | 0.48807 | 0.00000 |
| −0.30515 | 0.45574 | 0.00000 |
| −0.26940 | 0.42182 | 0.00000 |
| −0.23238 | 0.38637 | 0.00000 |
| −0.19409 | 0.34940 | 0.00000 |
| −0.15452 | 0.31093 | 0.00000 |
| −0.11365 | 0.27096 | 0.00000 |
| −0.07145 | 0.22953 | 0.00000 |
| −0.02933 | 0.18801 | 0.00000 |
| 0.01265 | 0.14636 | 0.00000 |
| 0.05441 | 0.10449 | 0.00000 |
| 0.09592 | 0.06237 | 0.00000 |
| 0.13711 | 0.01993 | 0.00000 |
| 0.17788 | −0.02290 | 0.00000 |
| 0.21840 | −0.06598 | 0.00000 |
| 0.25881 | −0.10915 | 0.00000 |
| 0.29921 | −0.15234 | 0.00000 |
| 0.33967 | −0.19546 | 0.00000 |
| 0.38029 | −0.23845 | 0.00000 |
| 0.41976 | −0.27980 | 0.00000 |
| 0.45812 | −0.31947 | 0.00000 |
| 0.49541 | −0.35743 | 0.00000 |
| 0.53163 | −0.39365 | 0.00000 |
| 0.56682 | −0.42810 | 0.00000 |
| 0.60098 | −0.46077 | 0.00000 |
| 0.63414 | −0.49163 | 0.00000 |
| 0.66627 | −0.52072 | 0.00000 |
| 0.69582 | −0.54681 | 0.00000 |
| 0.72281 | −0.56989 | 0.00000 |
| 0.74724 | −0.58987 | 0.00000 |
| 0.77064 | −0.60797 | 0.00000 |
| 0.79127 | −0.62320 | 0.00000 |
| 0.80730 | −0.63471 | 0.00000 |
| 0.82018 | −0.64383 | 0.00000 |
| 0.82838 | −0.65218 | 0.00000 |
| 0.83057 | −0.66071 | 0.00000 |
| 0.83003 | −0.66559 | 0.00000 |
| 0.82904 | −0.66858 | 0.00000 |
| 0.82837 | −0.67000 | 0.00000 |
| 0.82798 | −0.67069 | 0.00000 |
| 0.82778 | −0.67103 | 0.00000 |
| 0.82178 | −0.67242 | 0.23000 |
| 0.82131 | −0.67312 | 0.23000 |
| 0.82027 | −0.67444 | 0.23000 |
| 0.81789 | −0.67677 | 0.23000 |
| 0.81347 | −0.67950 | 0.23000 |
| 0.80433 | −0.68104 | 0.23000 |
| 0.79289 | −0.67673 | 0.23000 |
| 0.77846 | −0.66900 | 0.23000 |
| 0.76043 | −0.65933 | 0.23000 |
| 0.73695 | −0.64683 | 0.23000 |
| 0.70970 | −0.63273 | 0.23000 |
| 0.68043 | −0.61806 | 0.23000 |
| 0.64741 | −0.60176 | 0.23000 |
| 0.61075 | −0.58359 | 0.23000 |
| 0.57054 | −0.56336 | 0.23000 |
| 0.52862 | −0.54197 | 0.23000 |
| 0.48505 | −0.51934 | 0.23000 |
| 0.43990 | −0.49532 | 0.23000 |
| 0.39325 | −0.46976 | 0.23000 |
| 0.34520 | −0.44254 | 0.23000 |
| 0.29584 | −0.41352 | 0.23000 |
| 0.24526 | −0.38253 | 0.23000 |
| 0.19360 | −0.34941 | 0.23000 |
| 0.14275 | −0.31518 | 0.23000 |
| 0.09276 | −0.27976 | 0.23000 |
| 0.04369 | −0.24306 | 0.23000 |
| −0.00440 | −0.20501 | 0.23000 |
| −0.05131 | −0.16546 | 0.23000 |
| −0.09665 | −0.12454 | 0.23000 |
| −0.14052 | −0.08238 | 0.23000 |
| −0.18299 | −0.03905 | 0.23000 |
| −0.22412 | 0.00541 | 0.23000 |
| −0.26396 | 0.05094 | 0.23000 |
| −0.30259 | 0.09749 | 0.23000 |
| −0.33876 | 0.14346 | 0.23000 |
| −0.37257 | 0.18878 | 0.23000 |

TABLE 1-continued

| X | Y | Z |
|---|---|---|
| −0.40410 | 0.23339 | 0.23000 |
| −0.43343 | 0.27720 | 0.23000 |
| −0.46064 | 0.32016 | 0.23000 |
| −0.48576 | 0.36224 | 0.23000 |
| −0.50871 | 0.40327 | 0.23000 |
| −0.52867 | 0.44121 | 0.23000 |
| −0.54586 | 0.47594 | 0.23000 |
| −0.56016 | 0.50753 | 0.23000 |
| −0.57174 | 0.53588 | 0.23000 |
| −0.58102 | 0.56081 | 0.23000 |
| −0.58816 | 0.58223 | 0.23000 |
| −0.59347 | 0.60076 | 0.23000 |
| −0.59720 | 0.61649 | 0.23000 |
| −0.59916 | 0.62969 | 0.23000 |
| −0.59924 | 0.64048 | 0.23000 |
| −0.59788 | 0.64866 | 0.23000 |
| −0.59575 | 0.65453 | 0.23000 |
| −0.59309 | 0.65900 | 0.23000 |
| −0.59033 | 0.66212 | 0.23000 |
| −0.58789 | 0.66408 | 0.23000 |
| −0.58535 | 0.66560 | 0.23000 |
| −0.58172 | 0.66705 | 0.23000 |
| −0.57688 | 0.66802 | 0.23000 |
| −0.57102 | 0.66812 | 0.23000 |
| −0.56325 | 0.66686 | 0.23000 |
| −0.55358 | 0.66354 | 0.23000 |
| −0.54223 | 0.65777 | 0.23000 |
| −0.52909 | 0.64954 | 0.23000 |
| −0.51389 | 0.63907 | 0.23000 |
| −0.49656 | 0.62618 | 0.23000 |
| −0.47648 | 0.61041 | 0.23000 |
| −0.45368 | 0.59177 | 0.23000 |
| −0.42835 | 0.57003 | 0.23000 |
| −0.40055 | 0.54514 | 0.23000 |
| −0.37007 | 0.51736 | 0.23000 |
| −0.33690 | 0.48671 | 0.23000 |
| −0.30259 | 0.45440 | 0.23000 |
| −0.26707 | 0.42052 | 0.23000 |
| −0.23029 | 0.38511 | 0.23000 |
| −0.19224 | 0.34818 | 0.23000 |
| −0.15293 | 0.30975 | 0.23000 |
| −0.11232 | 0.26982 | 0.23000 |
| −0.07039 | 0.22844 | 0.23000 |
| −0.02856 | 0.18696 | 0.23000 |
| 0.01312 | 0.14533 | 0.23000 |
| 0.05459 | 0.10349 | 0.23000 |
| 0.09580 | 0.06139 | 0.23000 |
| 0.13668 | 0.01898 | 0.23000 |
| 0.17715 | −0.02383 | 0.23000 |
| 0.21736 | −0.06688 | 0.23000 |
| 0.25746 | −0.11003 | 0.23000 |
| 0.29755 | −0.15321 | 0.23000 |
| 0.33770 | −0.19631 | 0.23000 |
| 0.37799 | −0.23928 | 0.23000 |
| 0.41715 | −0.28063 | 0.23000 |
| 0.45520 | −0.32031 | 0.23000 |
| 0.49219 | −0.35828 | 0.23000 |
| 0.52813 | −0.39450 | 0.23000 |
| 0.56303 | −0.42897 | 0.23000 |
| 0.59692 | −0.46166 | 0.23000 |
| 0.62983 | −0.49255 | 0.23000 |
| 0.66171 | −0.52166 | 0.23000 |
| 0.69103 | −0.54778 | 0.23000 |
| 0.71781 | −0.57088 | 0.23000 |
| 0.74207 | −0.59090 | 0.23000 |
| 0.76529 | −0.60903 | 0.23000 |
| 0.78578 | −0.62429 | 0.23000 |
| 0.80169 | −0.63584 | 0.23000 |
| 0.81448 | −0.64498 | 0.23000 |
| 0.82265 | −0.65330 | 0.23000 |
| 0.82482 | −0.66179 | 0.23000 |
| 0.82427 | −0.66666 | 0.23000 |
| 0.82327 | −0.66963 | 0.23000 |
| 0.82259 | −0.67104 | 0.23000 |
| 0.82221 | −0.67173 | 0.23000 |
| 0.82200 | −0.67207 | 0.23000 |
| 0.80766 | −0.67152 | 0.77720 |
| 0.80719 | −0.67220 | 0.77720 |

TABLE 1-continued

| X | Y | Z |
|---|---|---|
| 0.80616 | −0.67350 | 0.77720 |
| 0.80378 | −0.67577 | 0.77720 |
| 0.79937 | −0.67840 | 0.77720 |
| 0.79031 | −0.67976 | 0.77720 |
| 0.77908 | −0.67530 | 0.77720 |
| 0.76490 | −0.66751 | 0.77720 |
| 0.74718 | −0.65776 | 0.77720 |
| 0.72412 | −0.64515 | 0.77720 |
| 0.69734 | −0.63090 | 0.77720 |
| 0.66857 | −0.61609 | 0.77720 |
| 0.63611 | −0.59963 | 0.77720 |
| 0.60006 | −0.58128 | 0.77720 |
| 0.56054 | −0.56087 | 0.77720 |
| 0.51933 | −0.53930 | 0.77720 |
| 0.47650 | −0.51649 | 0.77720 |
| 0.43211 | −0.49230 | 0.77720 |
| 0.38625 | −0.46659 | 0.77720 |
| 0.33902 | −0.43923 | 0.77720 |
| 0.29049 | −0.41010 | 0.77720 |
| 0.24077 | −0.37902 | 0.77720 |
| 0.19002 | −0.34583 | 0.77720 |
| 0.14005 | −0.31157 | 0.77720 |
| 0.09092 | −0.27615 | 0.77720 |
| 0.04270 | −0.23949 | 0.77720 |
| −0.00455 | −0.20151 | 0.77720 |
| −0.05061 | −0.16210 | 0.77720 |
| −0.09511 | −0.12136 | 0.77720 |
| −0.13816 | −0.07942 | 0.77720 |
| −0.17985 | −0.03634 | 0.77720 |
| −0.22022 | 0.00783 | 0.77720 |
| −0.25933 | 0.05304 | 0.77720 |
| −0.29725 | 0.09926 | 0.77720 |
| −0.33276 | 0.14488 | 0.77720 |
| −0.36594 | 0.18984 | 0.77720 |
| −0.39688 | 0.23409 | 0.77720 |
| −0.42566 | 0.27753 | 0.77720 |
| −0.45237 | 0.32011 | 0.77720 |
| −0.47703 | 0.36179 | 0.77720 |
| −0.49954 | 0.40244 | 0.77720 |
| −0.51912 | 0.44000 | 0.77720 |
| −0.53598 | 0.47439 | 0.77720 |
| −0.55001 | 0.50564 | 0.77720 |
| −0.56138 | 0.53370 | 0.77720 |
| −0.57047 | 0.55836 | 0.77720 |
| −0.57746 | 0.57955 | 0.77720 |
| −0.58266 | 0.59787 | 0.77720 |
| −0.58628 | 0.61344 | 0.77720 |
| −0.58821 | 0.62648 | 0.77720 |
| −0.58829 | 0.63714 | 0.77720 |
| −0.58694 | 0.64522 | 0.77720 |
| −0.58484 | 0.65102 | 0.77720 |
| −0.58221 | 0.65544 | 0.77720 |
| −0.57948 | 0.65850 | 0.77720 |
| −0.57707 | 0.66044 | 0.77720 |
| −0.57452 | 0.66193 | 0.77720 |
| −0.57090 | 0.66334 | 0.77720 |
| −0.56611 | 0.66425 | 0.77720 |
| −0.56032 | 0.66428 | 0.77720 |
| −0.55265 | 0.66294 | 0.77720 |
| −0.54312 | 0.65955 | 0.77720 |
| −0.53195 | 0.65371 | 0.77720 |
| −0.51904 | 0.64545 | 0.77720 |
| −0.50409 | 0.63498 | 0.77720 |
| −0.48704 | 0.62210 | 0.77720 |
| −0.46730 | 0.60637 | 0.77720 |
| −0.44488 | 0.58776 | 0.77720 |
| −0.41999 | 0.56608 | 0.77720 |
| −0.39266 | 0.54128 | 0.77720 |
| −0.36271 | 0.51361 | 0.77720 |
| −0.33011 | 0.48307 | 0.77720 |
| −0.29639 | 0.45088 | 0.77720 |
| −0.26150 | 0.41713 | 0.77720 |
| −0.22537 | 0.38185 | 0.77720 |
| −0.18799 | 0.34508 | 0.77720 |
| −0.14937 | 0.30680 | 0.77720 |
| −0.10948 | 0.26704 | 0.77720 |
| −0.06830 | 0.22583 | 0.77720 |
| −0.02721 | 0.18452 | 0.77720 |

TABLE 1-continued

| X | Y | Z |
|---|---|---|
| 0.01374 | 0.14308 | 0.77720 |
| 0.05447 | 0.10142 | 0.77720 |
| 0.09494 | 0.05952 | 0.77720 |
| 0.13510 | 0.01730 | 0.77720 |
| 0.17484 | −0.02530 | 0.77720 |
| 0.21433 | −0.06814 | 0.77720 |
| 0.25371 | −0.11107 | 0.77720 |
| 0.29307 | −0.15403 | 0.77720 |
| 0.33250 | −0.19692 | 0.77720 |
| 0.37206 | −0.23969 | 0.77720 |
| 0.41051 | −0.28085 | 0.77720 |
| 0.44787 | −0.32035 | 0.77720 |
| 0.48418 | −0.35816 | 0.77720 |
| 0.51946 | −0.39424 | 0.77720 |
| 0.55373 | −0.42859 | 0.77720 |
| 0.58700 | −0.46118 | 0.77720 |
| 0.61929 | −0.49199 | 0.77720 |
| 0.65059 | −0.52104 | 0.77720 |
| 0.67937 | −0.54711 | 0.77720 |
| 0.70565 | −0.57019 | 0.77720 |
| 0.72946 | −0.59020 | 0.77720 |
| 0.75226 | −0.60835 | 0.77720 |
| 0.77238 | −0.62363 | 0.77720 |
| 0.78799 | −0.63521 | 0.77720 |
| 0.80055 | −0.64438 | 0.77720 |
| 0.80862 | −0.65263 | 0.77720 |
| 0.81075 | −0.66103 | 0.77720 |
| 0.81018 | −0.66584 | 0.77720 |
| 0.80916 | −0.66877 | 0.77720 |
| 0.80848 | −0.67016 | 0.77720 |
| 0.80809 | −0.67084 | 0.77720 |
| 0.80789 | −0.67117 | 0.77720 |
| 0.79311 | −0.66798 | 1.32450 |
| 0.79264 | −0.66864 | 1.32450 |
| 0.79162 | −0.66991 | 1.32450 |
| 0.78925 | −0.67213 | 1.32450 |
| 0.78489 | −0.67467 | 1.32450 |
| 0.77598 | −0.67592 | 1.32450 |
| 0.76494 | −0.67140 | 1.32450 |
| 0.75101 | −0.66362 | 1.32450 |
| 0.73360 | −0.65388 | 1.32450 |
| 0.71094 | −0.64127 | 1.32450 |
| 0.68463 | −0.62702 | 1.32450 |
| 0.65637 | −0.61221 | 1.32450 |
| 0.62447 | −0.59573 | 1.32450 |
| 0.58905 | −0.57738 | 1.32450 |
| 0.55020 | −0.55696 | 1.32450 |
| 0.50971 | −0.53541 | 1.32450 |
| 0.46762 | −0.51261 | 1.32450 |
| 0.42401 | −0.48844 | 1.32450 |
| 0.37895 | −0.46277 | 1.32450 |
| 0.33255 | −0.43547 | 1.32450 |
| 0.28488 | −0.40640 | 1.32450 |
| 0.23607 | −0.37541 | 1.32450 |
| 0.18621 | −0.34232 | 1.32450 |
| 0.13715 | −0.30818 | 1.32450 |
| 0.08893 | −0.27292 | 1.32450 |
| 0.04163 | −0.23647 | 1.32450 |
| −0.00470 | −0.19872 | 1.32450 |
| −0.04991 | −0.15952 | 1.32450 |
| −0.09367 | −0.11894 | 1.32450 |
| −0.13598 | −0.07719 | 1.32450 |
| −0.17692 | −0.03435 | 1.32450 |
| −0.21653 | 0.00956 | 1.32450 |
| −0.25489 | 0.05447 | 1.32450 |
| −0.29205 | 0.10033 | 1.32450 |
| −0.32683 | 0.14559 | 1.32450 |
| −0.35931 | 0.19016 | 1.32450 |
| −0.38957 | 0.23399 | 1.32450 |
| −0.41771 | 0.27700 | 1.32450 |
| −0.44380 | 0.31912 | 1.32450 |
| −0.46788 | 0.36034 | 1.32450 |
| −0.48989 | 0.40061 | 1.32450 |
| −0.50903 | 0.43785 | 1.32450 |
| −0.52551 | 0.47190 | 1.32450 |
| −0.53922 | 0.50284 | 1.32450 |
| −0.55029 | 0.53059 | 1.32450 |
| −0.55911 | 0.55500 | 1.32450 |

TABLE 1-continued

| X | Y | Z |
|---|---|---|
| −0.56588 | 0.57595 | 1.32450 |
| −0.57090 | 0.59409 | 1.32450 |
| −0.57443 | 0.60948 | 1.32450 |
| −0.57631 | 0.62235 | 1.32450 |
| −0.57637 | 0.63288 | 1.32450 |
| −0.57503 | 0.64086 | 1.32450 |
| −0.57293 | 0.64658 | 1.32450 |
| −0.57032 | 0.65094 | 1.32450 |
| −0.56760 | 0.65396 | 1.32450 |
| −0.56520 | 0.65586 | 1.32450 |
| −0.56268 | 0.65731 | 1.32450 |
| −0.55909 | 0.65866 | 1.32450 |
| −0.55435 | 0.65951 | 1.32450 |
| −0.54863 | 0.65948 | 1.32450 |
| −0.54108 | 0.65807 | 1.32450 |
| −0.53171 | 0.65461 | 1.32450 |
| −0.52075 | 0.64873 | 1.32450 |
| −0.50807 | 0.64047 | 1.32450 |
| −0.49340 | 0.63001 | 1.32450 |
| −0.47666 | 0.61718 | 1.32450 |
| −0.45728 | 0.60151 | 1.32450 |
| −0.43529 | 0.58299 | 1.32450 |
| −0.41089 | 0.56139 | 1.32450 |
| −0.38410 | 0.53671 | 1.32450 |
| −0.35472 | 0.50919 | 1.32450 |
| −0.32275 | 0.47883 | 1.32450 |
| −0.28968 | 0.44685 | 1.32450 |
| −0.25545 | 0.41330 | 1.32450 |
| −0.22002 | 0.37825 | 1.32450 |
| −0.18337 | 0.34170 | 1.32450 |
| −0.14550 | 0.30367 | 1.32450 |
| −0.10639 | 0.26416 | 1.32450 |
| −0.06602 | 0.22321 | 1.32450 |
| −0.02574 | 0.18216 | 1.32450 |
| 0.01440 | 0.14098 | 1.32450 |
| 0.05433 | 0.09960 | 1.32450 |
| 0.09402 | 0.05798 | 1.32450 |
| 0.13338 | 0.01605 | 1.32450 |
| 0.17234 | −0.02625 | 1.32450 |
| 0.21104 | −0.06878 | 1.32450 |
| 0.24965 | −0.11141 | 1.32450 |
| 0.28825 | −0.15404 | 1.32450 |
| 0.32690 | −0.19662 | 1.32450 |
| 0.36570 | −0.23907 | 1.32450 |
| 0.40340 | −0.27993 | 1.32450 |
| 0.44004 | −0.31915 | 1.32450 |
| 0.47565 | −0.35669 | 1.32450 |
| 0.51026 | −0.39252 | 1.32450 |
| 0.54388 | −0.42663 | 1.32450 |
| 0.57652 | −0.45900 | 1.32450 |
| 0.60821 | −0.48960 | 1.32450 |
| 0.63892 | −0.51847 | 1.32450 |
| 0.66716 | −0.54439 | 1.32450 |
| 0.69295 | −0.56734 | 1.32450 |
| 0.71633 | −0.58724 | 1.32450 |
| 0.73873 | −0.60529 | 1.32450 |
| 0.75848 | −0.62051 | 1.32450 |
| 0.77382 | −0.63204 | 1.32450 |
| 0.78614 | −0.64119 | 1.32450 |
| 0.79411 | −0.64933 | 1.32450 |
| 0.79620 | −0.65764 | 1.32450 |
| 0.79562 | −0.66238 | 1.32450 |
| 0.79461 | −0.66527 | 1.32450 |
| 0.79392 | −0.66664 | 1.32450 |
| 0.79354 | −0.66731 | 1.32450 |
| 0.79333 | −0.66764 | 1.32450 |
| 0.77378 | −0.66171 | 2.02550 |
| 0.77331 | −0.66236 | 2.02550 |
| 0.77230 | −0.66360 | 2.02550 |
| 0.76995 | −0.66576 | 2.02550 |
| 0.76564 | −0.66821 | 2.02550 |
| 0.75685 | −0.66931 | 2.02550 |
| 0.74606 | −0.66472 | 2.02550 |
| 0.73241 | −0.65700 | 2.02550 |
| 0.71536 | −0.64731 | 2.02550 |
| 0.69317 | −0.63477 | 2.02550 |
| 0.66739 | −0.62060 | 2.02550 |
| 0.63970 | −0.60588 | 2.02550 |

TABLE 1-continued

| X | Y | Z |
|---|---|---|
| 0.60843 | −0.58951 | 2.02550 |
| 0.57371 | −0.57128 | 2.02550 |
| 0.53564 | −0.55100 | 2.02550 |
| 0.49596 | −0.52957 | 2.02550 |
| 0.45472 | −0.50692 | 2.02550 |
| 0.41199 | −0.48291 | 2.02550 |
| 0.36786 | −0.45740 | 2.02550 |
| 0.32242 | −0.43027 | 2.02550 |
| 0.27576 | −0.40139 | 2.02550 |
| 0.22798 | −0.37059 | 2.02550 |
| 0.17922 | −0.33773 | 2.02550 |
| 0.13124 | −0.30382 | 2.02550 |
| 0.08412 | −0.26879 | 2.02550 |
| 0.03791 | −0.23257 | 2.02550 |
| −0.00734 | −0.19506 | 2.02550 |
| −0.05142 | −0.15615 | 2.02550 |
| −0.09398 | −0.11595 | 2.02550 |
| −0.13511 | −0.07460 | 2.02550 |
| −0.17487 | −0.03216 | 2.02550 |
| −0.21333 | 0.01132 | 2.02550 |
| −0.25054 | 0.05579 | 2.02550 |
| −0.28656 | 0.10122 | 2.02550 |
| −0.32025 | 0.14603 | 2.02550 |
| −0.35169 | 0.19017 | 2.02550 |
| −0.38095 | 0.23357 | 2.02550 |
| −0.40814 | 0.27615 | 2.02550 |
| −0.43332 | 0.31787 | 2.02550 |
| −0.45652 | 0.35869 | 2.02550 |
| −0.47765 | 0.39850 | 2.02550 |
| −0.49598 | 0.43527 | 2.02550 |
| −0.51177 | 0.46889 | 2.02550 |
| −0.52485 | 0.49944 | 2.02550 |
| −0.53535 | 0.52685 | 2.02550 |
| −0.54369 | 0.55094 | 2.02550 |
| −0.55004 | 0.57163 | 2.02550 |
| −0.55471 | 0.58951 | 2.02550 |
| −0.55796 | 0.60468 | 2.02550 |
| −0.55964 | 0.61735 | 2.02550 |
| −0.55959 | 0.62770 | 2.02550 |
| −0.55819 | 0.63552 | 2.02550 |
| −0.55608 | 0.64113 | 2.02550 |
| −0.55346 | 0.64539 | 2.02550 |
| −0.55076 | 0.64832 | 2.02550 |
| −0.54839 | 0.65015 | 2.02550 |
| −0.54590 | 0.65155 | 2.02550 |
| −0.54236 | 0.65284 | 2.02550 |
| −0.53770 | 0.65362 | 2.02550 |
| −0.53207 | 0.65352 | 2.02550 |
| −0.52467 | 0.65205 | 2.02550 |
| −0.51552 | 0.64854 | 2.02550 |
| −0.50483 | 0.64265 | 2.02550 |
| −0.49245 | 0.63441 | 2.02550 |
| −0.47813 | 0.62402 | 2.02550 |
| −0.46179 | 0.61130 | 2.02550 |
| −0.44289 | 0.59577 | 2.02550 |
| −0.42145 | 0.57739 | 2.02550 |
| −0.39769 | 0.55597 | 2.02550 |
| −0.37161 | 0.53149 | 2.02550 |
| −0.34301 | 0.50421 | 2.02550 |
| −0.31187 | 0.47413 | 2.02550 |
| −0.27967 | 0.44244 | 2.02550 |
| −0.24635 | 0.40921 | 2.02550 |
| −0.21187 | 0.37449 | 2.02550 |
| −0.17620 | 0.33828 | 2.02550 |
| −0.13936 | 0.30060 | 2.02550 |
| −0.10131 | 0.26146 | 2.02550 |
| −0.06204 | 0.22088 | 2.02550 |
| −0.02285 | 0.18022 | 2.02550 |
| 0.01619 | 0.13943 | 2.02550 |
| 0.05502 | 0.09843 | 2.02550 |
| 0.09360 | 0.05720 | 2.02550 |
| 0.13187 | 0.01567 | 2.02550 |
| 0.16973 | −0.02623 | 2.02550 |
| 0.20733 | −0.06835 | 2.02550 |
| 0.24484 | −0.11056 | 2.02550 |
| 0.28233 | −0.15279 | 2.02550 |
| 0.31989 | −0.19495 | 2.02550 |
| 0.35759 | −0.23700 | 2.02550 |

TABLE 1-continued

| X | Y | Z |
|---|---|---|
| 0.39423 | −0.27746 | 2.02550 |
| 0.42985 | −0.31630 | 2.02550 |
| 0.46449 | −0.35348 | 2.02550 |
| 0.49815 | −0.38897 | 2.02550 |
| 0.53086 | −0.42275 | 2.02550 |
| 0.56263 | −0.45482 | 2.02550 |
| 0.59349 | −0.48513 | 2.02550 |
| 0.62340 | −0.51374 | 2.02550 |
| 0.65092 | −0.53942 | 2.02550 |
| 0.67606 | −0.56216 | 2.02550 |
| 0.69885 | −0.58189 | 2.02550 |
| 0.72070 | −0.59979 | 2.02550 |
| 0.73999 | −0.61487 | 2.02550 |
| 0.75495 | −0.62632 | 2.02550 |
| 0.76698 | −0.63541 | 2.02550 |
| 0.77480 | −0.64341 | 2.02550 |
| 0.77686 | −0.65156 | 2.02550 |
| 0.77628 | −0.65622 | 2.02550 |
| 0.77527 | −0.65906 | 2.02550 |
| 0.77459 | −0.66040 | 2.02550 |
| 0.77420 | −0.66105 | 2.02550 |
| 0.77400 | −0.66137 | 2.02550 |
| 0.75397 | −0.65482 | 2.72650 |
| 0.75350 | −0.65546 | 2.72650 |
| 0.75250 | −0.65667 | 2.72650 |
| 0.75019 | −0.65878 | 2.72650 |
| 0.74594 | −0.66116 | 2.72650 |
| 0.73730 | −0.66216 | 2.72650 |
| 0.72673 | −0.65757 | 2.72650 |
| 0.71333 | −0.64995 | 2.72650 |
| 0.69660 | −0.64039 | 2.72650 |
| 0.67482 | −0.62802 | 2.72650 |
| 0.64952 | −0.61405 | 2.72650 |
| 0.62233 | −0.59953 | 2.72650 |
| 0.59163 | −0.58339 | 2.72650 |
| 0.55755 | −0.56541 | 2.72650 |
| 0.52018 | −0.54540 | 2.72650 |
| 0.48123 | −0.52426 | 2.72650 |
| 0.44076 | −0.50191 | 2.72650 |
| 0.39884 | −0.47820 | 2.72650 |
| 0.35554 | −0.45300 | 2.72650 |
| 0.31098 | −0.42620 | 2.72650 |
| 0.26524 | −0.39764 | 2.72650 |
| 0.21841 | −0.36718 | 2.72650 |
| 0.17065 | −0.33465 | 2.72650 |
| 0.12370 | −0.30107 | 2.72650 |
| 0.07761 | −0.26637 | 2.72650 |
| 0.03244 | −0.23048 | 2.72650 |
| −0.01174 | −0.19329 | 2.72650 |
| −0.05473 | −0.15468 | 2.72650 |
| −0.09616 | −0.11479 | 2.72650 |
| −0.13614 | −0.07376 | 2.72650 |
| −0.17474 | −0.03165 | 2.72650 |
| −0.21200 | 0.01151 | 2.72650 |
| −0.24800 | 0.05565 | 2.72650 |
| −0.28280 | 0.10075 | 2.72650 |
| −0.31528 | 0.14524 | 2.72650 |
| −0.34553 | 0.18908 | 2.72650 |
| −0.37363 | 0.23218 | 2.72650 |
| −0.39968 | 0.27448 | 2.72650 |
| −0.42374 | 0.31593 | 2.72650 |
| −0.44583 | 0.35649 | 2.72650 |
| −0.46584 | 0.39595 | 2.72650 |
| −0.48315 | 0.43238 | 2.72650 |
| −0.49799 | 0.46570 | 2.72650 |
| −0.51022 | 0.49595 | 2.72650 |
| −0.51997 | 0.52309 | 2.72650 |
| −0.52763 | 0.54695 | 2.72650 |
| −0.53341 | 0.56743 | 2.72650 |
| −0.53758 | 0.58509 | 2.72650 |
| −0.54041 | 0.60006 | 2.72650 |
| −0.54177 | 0.61255 | 2.72650 |
| −0.54149 | 0.62271 | 2.72650 |
| −0.53996 | 0.63036 | 2.72650 |
| −0.53778 | 0.63583 | 2.72650 |
| −0.53514 | 0.63996 | 2.72650 |
| −0.53244 | 0.64280 | 2.72650 |
| −0.53008 | 0.64457 | 2.72650 |

TABLE 1-continued

| X | Y | Z |
|---|---|---|
| −0.52763 | 0.64590 | 2.72650 |
| −0.52417 | 0.64712 | 2.72650 |
| −0.51959 | 0.64785 | 2.72650 |
| −0.51409 | 0.64772 | 2.72650 |
| −0.50684 | 0.64624 | 2.72650 |
| −0.49787 | 0.64277 | 2.72650 |
| −0.48739 | 0.63696 | 2.72650 |
| −0.47528 | 0.62884 | 2.72650 |
| −0.46127 | 0.61861 | 2.72650 |
| −0.44530 | 0.60606 | 2.72650 |
| −0.42683 | 0.59072 | 2.72650 |
| −0.40593 | 0.57256 | 2.72650 |
| −0.38277 | 0.55137 | 2.72650 |
| −0.35739 | 0.52715 | 2.72650 |
| −0.32957 | 0.50015 | 2.72650 |
| −0.29928 | 0.47038 | 2.72650 |
| −0.26799 | 0.43901 | 2.72650 |
| −0.23562 | 0.40610 | 2.72650 |
| −0.20212 | 0.37172 | 2.72650 |
| −0.16747 | 0.33588 | 2.72650 |
| −0.13168 | 0.29858 | 2.72650 |
| −0.09473 | 0.25983 | 2.72650 |
| −0.05659 | 0.21966 | 2.72650 |
| −0.01855 | 0.17940 | 2.72650 |
| 0.01935 | 0.13901 | 2.72650 |
| 0.05702 | 0.09842 | 2.72650 |
| 0.09444 | 0.05758 | 2.72650 |
| 0.13153 | 0.01643 | 2.72650 |
| 0.16820 | −0.02509 | 2.72650 |
| 0.20460 | −0.06683 | 2.72650 |
| 0.24090 | −0.10867 | 2.72650 |
| 0.27717 | −0.15053 | 2.72650 |
| 0.31350 | −0.19234 | 2.72650 |
| 0.34996 | −0.23404 | 2.72650 |
| 0.38542 | −0.27416 | 2.72650 |
| 0.41990 | −0.31268 | 2.72650 |
| 0.45343 | −0.34955 | 2.72650 |
| 0.48604 | −0.38475 | 2.72650 |
| 0.51773 | −0.41826 | 2.72650 |
| 0.54854 | −0.45006 | 2.72650 |
| 0.57848 | −0.48013 | 2.72650 |
| 0.60752 | −0.50849 | 2.72650 |
| 0.63424 | −0.53396 | 2.72650 |
| 0.65869 | −0.55650 | 2.72650 |
| 0.68088 | −0.57605 | 2.72650 |
| 0.70217 | −0.59378 | 2.72650 |
| 0.72098 | −0.60872 | 2.72650 |
| 0.73559 | −0.62004 | 2.72650 |
| 0.74732 | −0.62904 | 2.72650 |
| 0.75500 | −0.63689 | 2.72650 |
| 0.75701 | −0.64489 | 2.72650 |
| 0.75644 | −0.64946 | 2.72650 |
| 0.75544 | −0.65223 | 2.72650 |
| 0.75476 | −0.65355 | 2.72650 |
| 0.75439 | −0.65418 | 2.72650 |
| 0.75418 | −0.65450 | 2.72650 |
| 0.73972 | −0.65556 | 3.22850 |
| 0.73927 | −0.65618 | 3.22850 |
| 0.73829 | −0.65735 | 3.22850 |
| 0.73602 | −0.65941 | 3.22850 |
| 0.73186 | −0.66172 | 3.22850 |
| 0.72340 | −0.66268 | 3.22850 |
| 0.71300 | −0.65813 | 3.22850 |
| 0.69978 | −0.65056 | 3.22850 |
| 0.68329 | −0.64105 | 3.22850 |
| 0.66182 | −0.62874 | 3.22850 |
| 0.63688 | −0.61485 | 3.22850 |
| 0.61006 | −0.60042 | 3.22850 |
| 0.57977 | −0.58439 | 3.22850 |
| 0.54615 | −0.56653 | 3.22850 |
| 0.50929 | −0.54666 | 3.22850 |
| 0.47087 | −0.52566 | 3.22850 |
| 0.43095 | −0.50346 | 3.22850 |
| 0.38961 | −0.47989 | 3.22850 |
| 0.34692 | −0.45485 | 3.22850 |
| 0.30300 | −0.42819 | 3.22850 |
| 0.25792 | −0.39980 | 3.22850 |
| 0.21181 | −0.36949 | 3.22850 |

TABLE 1-continued

| X | Y | Z |
|---|---|---|
| 0.16477 | −0.33711 | 3.22850 |
| 0.11856 | −0.30368 | 3.22850 |
| 0.07323 | −0.26913 | 3.22850 |
| 0.02886 | −0.23339 | 3.22850 |
| −0.01449 | −0.19635 | 3.22850 |
| −0.05668 | −0.15787 | 3.22850 |
| −0.09739 | −0.11801 | 3.22850 |
| −0.13660 | −0.07703 | 3.22850 |
| −0.17440 | −0.03499 | 3.22850 |
| −0.21082 | 0.00809 | 3.22850 |
| −0.24595 | 0.05213 | 3.22850 |
| −0.27985 | 0.09710 | 3.22850 |
| −0.31144 | 0.14146 | 3.22850 |
| −0.34081 | 0.18513 | 3.22850 |
| −0.36803 | 0.22807 | 3.22850 |
| −0.39321 | 0.27020 | 3.22850 |
| −0.41642 | 0.31146 | 3.22850 |
| −0.43769 | 0.35182 | 3.22850 |
| −0.45693 | 0.39113 | 3.22850 |
| −0.47350 | 0.42742 | 3.22850 |
| −0.48767 | 0.46059 | 3.22850 |
| −0.49928 | 0.49070 | 3.22850 |
| −0.50844 | 0.51769 | 3.22850 |
| −0.51559 | 0.54141 | 3.22850 |
| −0.52093 | 0.56175 | 3.22850 |
| −0.52473 | 0.57930 | 3.22850 |
| −0.52724 | 0.59416 | 3.22850 |
| −0.52837 | 0.60653 | 3.22850 |
| −0.52792 | 0.61657 | 3.22850 |
| −0.52629 | 0.62412 | 3.22850 |
| −0.52405 | 0.62950 | 3.22850 |
| −0.52137 | 0.63355 | 3.22850 |
| −0.51866 | 0.63633 | 3.22850 |
| −0.51630 | 0.63805 | 3.22850 |
| −0.51387 | 0.63933 | 3.22850 |
| −0.51043 | 0.64049 | 3.22850 |
| −0.50591 | 0.64116 | 3.22850 |
| −0.50048 | 0.64097 | 3.22850 |
| −0.49334 | 0.63944 | 3.22850 |
| −0.48452 | 0.63593 | 3.22850 |
| −0.47422 | 0.63012 | 3.22850 |
| −0.46231 | 0.62204 | 3.22850 |
| −0.44855 | 0.61185 | 3.22850 |
| −0.43287 | 0.59936 | 3.22850 |
| −0.41475 | 0.58410 | 3.22850 |
| −0.39423 | 0.56604 | 3.22850 |
| −0.37152 | 0.54497 | 3.22850 |
| −0.34665 | 0.52088 | 3.22850 |
| −0.31939 | 0.49402 | 3.22850 |
| −0.28972 | 0.46441 | 3.22850 |
| −0.25907 | 0.43321 | 3.22850 |
| −0.22739 | 0.40048 | 3.22850 |
| −0.19461 | 0.36627 | 3.22850 |
| −0.16071 | 0.33061 | 3.22850 |
| −0.12571 | 0.29348 | 3.22850 |
| −0.08958 | 0.25491 | 3.22850 |
| −0.05230 | 0.21493 | 3.22850 |
| −0.01512 | 0.17485 | 3.22850 |
| 0.02192 | 0.13464 | 3.22850 |
| 0.05873 | 0.09422 | 3.22850 |
| 0.09527 | 0.05357 | 3.22850 |
| 0.13148 | 0.01260 | 3.22850 |
| 0.16725 | −0.02874 | 3.22850 |
| 0.20276 | −0.07031 | 3.22850 |
| 0.23815 | −0.11198 | 3.22850 |
| 0.27352 | −0.15366 | 3.22850 |
| 0.30896 | −0.19530 | 3.22850 |
| 0.34453 | −0.23681 | 3.22850 |
| 0.37911 | −0.27677 | 3.22850 |
| 0.41276 | −0.31513 | 3.22850 |
| 0.44550 | −0.35185 | 3.22850 |
| 0.47735 | −0.38689 | 3.22850 |
| 0.50832 | −0.42025 | 3.22850 |
| 0.53844 | −0.45191 | 3.22850 |
| 0.56772 | −0.48185 | 3.22850 |
| 0.59614 | −0.51009 | 3.22850 |
| 0.62231 | −0.53544 | 3.22850 |
| 0.64626 | −0.55788 | 3.22850 |

TABLE 1-continued

| X | Y | Z |
|---|---|---|
| 0.66800 | −0.57736 | 3.22850 |
| 0.68889 | −0.59501 | 3.22850 |
| 0.70736 | −0.60987 | 3.22850 |
| 0.72170 | −0.62115 | 3.22850 |
| 0.73322 | −0.63011 | 3.22850 |
| 0.74078 | −0.63787 | 3.22850 |
| 0.74277 | −0.64577 | 3.22850 |
| 0.74218 | −0.65028 | 3.22850 |
| 0.74119 | −0.65301 | 3.22850 |
| 0.74052 | −0.65431 | 3.22850 |
| 0.74014 | −0.65493 | 3.22850 |
| 0.73994 | −0.65524 | 3.22850 |
| 0.72534 | −0.66286 | 3.73050 |
| 0.72489 | −0.66348 | 3.73050 |
| 0.72388 | −0.66465 | 3.73050 |
| 0.72161 | −0.66667 | 3.73050 |
| 0.71740 | −0.66891 | 3.73050 |
| 0.70893 | −0.66967 | 3.73050 |
| 0.69877 | −0.66500 | 3.73050 |
| 0.68580 | −0.65746 | 3.73050 |
| 0.66962 | −0.64799 | 3.73050 |
| 0.64855 | −0.63572 | 3.73050 |
| 0.62407 | −0.62188 | 3.73050 |
| 0.59774 | −0.60749 | 3.73050 |
| 0.56802 | −0.59152 | 3.73050 |
| 0.53501 | −0.57371 | 3.73050 |
| 0.49883 | −0.55391 | 3.73050 |
| 0.46114 | −0.53299 | 3.73050 |
| 0.42202 | −0.51089 | 3.73050 |
| 0.38155 | −0.48747 | 3.73050 |
| 0.33982 | −0.46260 | 3.73050 |
| 0.29692 | −0.43617 | 3.73050 |
| 0.25295 | −0.40803 | 3.73050 |
| 0.20801 | −0.37806 | 3.73050 |
| 0.16221 | −0.34607 | 3.73050 |
| 0.11718 | −0.31302 | 3.73050 |
| 0.07296 | −0.27883 | 3.73050 |
| 0.02961 | −0.24342 | 3.73050 |
| −0.01280 | −0.20669 | 3.73050 |
| −0.05415 | −0.16848 | 3.73050 |
| −0.09432 | −0.12860 | 3.73050 |
| −0.13315 | −0.08737 | 3.73050 |
| −0.17049 | −0.04509 | 3.73050 |
| −0.20638 | −0.00180 | 3.73050 |
| −0.24093 | 0.04242 | 3.73050 |
| −0.27418 | 0.08754 | 3.73050 |
| −0.30509 | 0.13200 | 3.73050 |
| −0.33376 | 0.17575 | 3.73050 |
| −0.36028 | 0.21872 | 3.73050 |
| −0.38475 | 0.26084 | 3.73050 |
| −0.40726 | 0.30206 | 3.73050 |
| −0.42783 | 0.34234 | 3.73050 |
| −0.44642 | 0.38171 | 3.73050 |
| −0.46242 | 0.41808 | 3.73050 |
| −0.47605 | 0.45130 | 3.73050 |
| −0.48717 | 0.48142 | 3.73050 |
| −0.49587 | 0.50840 | 3.73050 |
| −0.50261 | 0.53208 | 3.73050 |
| −0.50759 | 0.55237 | 3.73050 |
| −0.51109 | 0.56990 | 3.73050 |
| −0.51334 | 0.58473 | 3.73050 |
| −0.51426 | 0.59705 | 3.73050 |
| −0.51368 | 0.60700 | 3.73050 |
| −0.51196 | 0.61445 | 3.73050 |
| −0.50968 | 0.61975 | 3.73050 |
| −0.50698 | 0.62372 | 3.73050 |
| −0.50427 | 0.62643 | 3.73050 |
| −0.50191 | 0.62810 | 3.73050 |
| −0.49950 | 0.62933 | 3.73050 |
| −0.49608 | 0.63043 | 3.73050 |
| −0.49161 | 0.63103 | 3.73050 |
| −0.48625 | 0.63077 | 3.73050 |
| −0.47922 | 0.62915 | 3.73050 |
| −0.47055 | 0.62557 | 3.73050 |
| −0.46046 | 0.61970 | 3.73050 |
| −0.44879 | 0.61158 | 3.73050 |
| −0.43531 | 0.60136 | 3.73050 |
| −0.41996 | 0.58884 | 3.73050 |

TABLE 1-continued

| X | Y | Z |
|---|---|---|
| −0.40223 | 0.57357 | 3.73050 |
| −0.38218 | 0.55549 | 3.73050 |
| −0.35999 | 0.53442 | 3.73050 |
| −0.33571 | 0.51033 | 3.73050 |
| −0.30909 | 0.48349 | 3.73050 |
| −0.28012 | 0.45390 | 3.73050 |
| −0.25021 | 0.42274 | 3.73050 |
| −0.21928 | 0.39005 | 3.73050 |
| −0.18728 | 0.35589 | 3.73050 |
| −0.15421 | 0.32027 | 3.73050 |
| −0.12006 | 0.28321 | 3.73050 |
| −0.08481 | 0.24470 | 3.73050 |
| −0.04844 | 0.20479 | 3.73050 |
| −0.01215 | 0.16479 | 3.73050 |
| 0.02399 | 0.12466 | 3.73050 |
| 0.05990 | 0.08434 | 3.73050 |
| 0.09555 | 0.04378 | 3.73050 |
| 0.13087 | 0.00292 | 3.73050 |
| 0.16575 | −0.03831 | 3.73050 |
| 0.20037 | −0.07975 | 3.73050 |
| 0.23489 | −0.12129 | 3.73050 |
| 0.26938 | −0.16284 | 3.73050 |
| 0.30394 | −0.20434 | 3.73050 |
| 0.33864 | −0.24571 | 3.73050 |
| 0.37239 | −0.28554 | 3.73050 |
| 0.40525 | −0.32376 | 3.73050 |
| 0.43722 | −0.36035 | 3.73050 |
| 0.46834 | −0.39527 | 3.73050 |
| 0.49862 | −0.42852 | 3.73050 |
| 0.52807 | −0.46007 | 3.73050 |
| 0.55673 | −0.48990 | 3.73050 |
| 0.58456 | −0.51804 | 3.73050 |
| 0.61019 | −0.54331 | 3.73050 |
| 0.63365 | −0.56568 | 3.73050 |
| 0.65497 | −0.58510 | 3.73050 |
| 0.67547 | −0.60269 | 3.73050 |
| 0.69360 | −0.61752 | 3.73050 |
| 0.70767 | −0.62877 | 3.73050 |
| 0.71898 | −0.63772 | 3.73050 |
| 0.72644 | −0.64540 | 3.73050 |
| 0.72840 | −0.65320 | 3.73050 |
| 0.72780 | −0.65765 | 3.73050 |
| 0.72681 | −0.66035 | 3.73050 |
| 0.72614 | −0.66163 | 3.73050 |
| 0.72576 | −0.66224 | 3.73050 |
| 0.72556 | −0.66255 | 3.73050 |
| 0.70983 | −0.67395 | 4.26400 |
| 0.70938 | −0.67455 | 4.26400 |
| 0.70841 | −0.67568 | 4.26400 |
| 0.70616 | −0.67764 | 4.26400 |
| 0.70205 | −0.67979 | 4.26400 |
| 0.69379 | −0.68048 | 4.26400 |
| 0.68377 | −0.67576 | 4.26400 |
| 0.67102 | −0.66818 | 4.26400 |
| 0.65511 | −0.65866 | 4.26400 |
| 0.63441 | −0.64631 | 4.26400 |
| 0.61036 | −0.63234 | 4.26400 |
| 0.58449 | −0.61783 | 4.26400 |
| 0.55527 | −0.60170 | 4.26400 |
| 0.52284 | −0.58372 | 4.26400 |
| 0.48729 | −0.56373 | 4.26400 |
| 0.45025 | −0.54260 | 4.26400 |
| 0.41181 | −0.52029 | 4.26400 |
| 0.37205 | −0.49664 | 4.26400 |
| 0.33109 | −0.47155 | 4.26400 |
| 0.28900 | −0.44490 | 4.26400 |
| 0.24587 | −0.41655 | 4.26400 |
| 0.20182 | −0.38636 | 4.26400 |
| 0.15697 | −0.35418 | 4.26400 |
| 0.11290 | −0.32096 | 4.26400 |
| 0.06966 | −0.28663 | 4.26400 |
| 0.02731 | −0.25111 | 4.26400 |
| −0.01409 | −0.21431 | 4.26400 |
| −0.05439 | −0.17606 | 4.26400 |
| −0.09349 | −0.13620 | 4.26400 |
| −0.13135 | −0.09491 | 4.26400 |
| −0.16773 | −0.05259 | 4.26400 |
| −0.20266 | −0.00931 | 4.26400 |

TABLE 1-continued

| X | Y | Z |
|---|---|---|
| −0.23621 | 0.03489 | 4.26400 |
| −0.26846 | 0.07995 | 4.26400 |
| −0.29840 | 0.12433 | 4.26400 |
| −0.32612 | 0.16797 | 4.26400 |
| −0.35172 | 0.21080 | 4.26400 |
| −0.37529 | 0.25276 | 4.26400 |
| −0.39694 | 0.29379 | 4.26400 |
| −0.41668 | 0.33386 | 4.26400 |
| −0.43448 | 0.37301 | 4.26400 |
| −0.44975 | 0.40921 | 4.26400 |
| −0.46274 | 0.44225 | 4.26400 |
| −0.47330 | 0.47218 | 4.26400 |
| −0.48152 | 0.49896 | 4.26400 |
| −0.48783 | 0.52245 | 4.26400 |
| −0.49247 | 0.54256 | 4.26400 |
| −0.49567 | 0.55994 | 4.26400 |
| −0.49770 | 0.57463 | 4.26400 |
| −0.49847 | 0.58681 | 4.26400 |
| −0.49780 | 0.59664 | 4.26400 |
| −0.49602 | 0.60399 | 4.26400 |
| −0.49370 | 0.60919 | 4.26400 |
| −0.49098 | 0.61309 | 4.26400 |
| −0.48825 | 0.61573 | 4.26400 |
| −0.48590 | 0.61734 | 4.26400 |
| −0.48347 | 0.61852 | 4.26400 |
| −0.48007 | 0.61955 | 4.26400 |
| −0.47563 | 0.62005 | 4.26400 |
| −0.47034 | 0.61966 | 4.26400 |
| −0.46344 | 0.61791 | 4.26400 |
| −0.45497 | 0.61417 | 4.26400 |
| −0.44514 | 0.60813 | 4.26400 |
| −0.43379 | 0.59986 | 4.26400 |
| −0.42068 | 0.58950 | 4.26400 |
| −0.40576 | 0.57685 | 4.26400 |
| −0.38853 | 0.56143 | 4.26400 |
| −0.36905 | 0.54322 | 4.26400 |
| −0.34753 | 0.52200 | 4.26400 |
| −0.32399 | 0.49777 | 4.26400 |
| −0.29816 | 0.47079 | 4.26400 |
| −0.27005 | 0.44109 | 4.26400 |
| −0.24102 | 0.40982 | 4.26400 |
| −0.21101 | 0.37702 | 4.26400 |
| −0.17996 | 0.34277 | 4.26400 |
| −0.14785 | 0.30708 | 4.26400 |
| −0.11469 | 0.26995 | 4.26400 |
| −0.08046 | 0.23138 | 4.26400 |
| −0.04511 | 0.19143 | 4.26400 |
| −0.00985 | 0.15140 | 4.26400 |
| 0.02527 | 0.11126 | 4.26400 |
| 0.06020 | 0.07094 | 4.26400 |
| 0.09487 | 0.03041 | 4.26400 |
| 0.12922 | −0.01041 | 4.26400 |
| 0.16315 | −0.05157 | 4.26400 |
| 0.19685 | −0.09292 | 4.26400 |
| 0.23046 | −0.13435 | 4.26400 |
| 0.26405 | −0.17579 | 4.26400 |
| 0.29773 | −0.21716 | 4.26400 |
| 0.33157 | −0.25839 | 4.26400 |
| 0.36450 | −0.29807 | 4.26400 |
| 0.39657 | −0.33616 | 4.26400 |
| 0.42780 | −0.37261 | 4.26400 |
| 0.45820 | −0.40740 | 4.26400 |
| 0.48780 | −0.44052 | 4.26400 |
| 0.51661 | −0.47196 | 4.26400 |
| 0.54464 | −0.50168 | 4.26400 |
| 0.57188 | −0.52972 | 4.26400 |
| 0.59698 | −0.55491 | 4.26400 |
| 0.61996 | −0.57721 | 4.26400 |
| 0.64085 | −0.59657 | 4.26400 |
| 0.66095 | −0.61413 | 4.26400 |
| 0.67873 | −0.62893 | 4.26400 |
| 0.69252 | −0.64017 | 4.26400 |
| 0.70360 | −0.64912 | 4.26400 |
| 0.71097 | −0.65673 | 4.26400 |
| 0.71290 | −0.66444 | 4.26400 |
| 0.71229 | −0.66883 | 4.26400 |
| 0.71130 | −0.67149 | 4.26400 |
| 0.71063 | −0.67274 | 4.26400 |

TABLE 1-continued

| X | Y | Z |
|---|---|---|
| 0.71025 | −0.67335 | 4.26400 |
| 0.71005 | −0.67365 | 4.26400 |
| 0.69415 | −0.68650 | 4.79750 |
| 0.69369 | −0.68710 | 4.79750 |
| 0.69268 | −0.68822 | 4.79750 |
| 0.69041 | −0.69015 | 4.79750 |
| 0.68623 | −0.69222 | 4.79750 |
| 0.67792 | −0.69263 | 4.79750 |
| 0.66812 | −0.68770 | 4.79750 |
| 0.65557 | −0.68006 | 4.79750 |
| 0.63991 | −0.67044 | 4.79750 |
| 0.61955 | −0.65797 | 4.79750 |
| 0.59589 | −0.64386 | 4.79750 |
| 0.57043 | −0.62916 | 4.79750 |
| 0.54170 | −0.61280 | 4.79750 |
| 0.50982 | −0.59456 | 4.79750 |
| 0.47488 | −0.57425 | 4.79750 |
| 0.43849 | −0.55279 | 4.79750 |
| 0.40069 | −0.53010 | 4.79750 |
| 0.36159 | −0.50603 | 4.79750 |
| 0.32126 | −0.48047 | 4.79750 |
| 0.27979 | −0.45329 | 4.79750 |
| 0.23727 | −0.42435 | 4.79750 |
| 0.19388 | −0.39356 | 4.79750 |
| 0.14977 | −0.36076 | 4.79750 |
| 0.10648 | −0.32696 | 4.79750 |
| 0.06408 | −0.29207 | 4.79750 |
| 0.02263 | −0.25603 | 4.79750 |
| −0.01781 | −0.21876 | 4.79750 |
| −0.05710 | −0.18009 | 4.79750 |
| −0.09492 | −0.14013 | 4.79750 |
| −0.13122 | −0.09913 | 4.79750 |
| −0.16609 | −0.05713 | 4.79750 |
| −0.19959 | −0.01419 | 4.79750 |
| −0.23179 | 0.02965 | 4.79750 |
| −0.26275 | 0.07436 | 4.79750 |
| −0.29148 | 0.11839 | 4.79750 |
| −0.31808 | 0.16171 | 4.79750 |
| −0.34263 | 0.20423 | 4.79750 |
| −0.36524 | 0.24589 | 4.79750 |
| −0.38597 | 0.28665 | 4.79750 |
| −0.40485 | 0.32648 | 4.79750 |
| −0.42180 | 0.36518 | 4.79750 |
| −0.43629 | 0.40086 | 4.79750 |
| −0.44857 | 0.43344 | 4.79750 |
| −0.45854 | 0.46295 | 4.79750 |
| −0.46628 | 0.48936 | 4.79750 |
| −0.47219 | 0.51254 | 4.79750 |
| −0.47651 | 0.53238 | 4.79750 |
| −0.47948 | 0.54946 | 4.79750 |
| −0.48134 | 0.56389 | 4.79750 |
| −0.48202 | 0.57586 | 4.79750 |
| −0.48128 | 0.58554 | 4.79750 |
| −0.47947 | 0.59276 | 4.79750 |
| −0.47714 | 0.59787 | 4.79750 |
| −0.47441 | 0.60167 | 4.79750 |
| −0.47168 | 0.60423 | 4.79750 |
| −0.46933 | 0.60577 | 4.79750 |
| −0.46691 | 0.60688 | 4.79750 |
| −0.46352 | 0.60781 | 4.79750 |
| −0.45913 | 0.60817 | 4.79750 |
| −0.45390 | 0.60763 | 4.79750 |
| −0.44714 | 0.60569 | 4.79750 |
| −0.43890 | 0.60175 | 4.79750 |
| −0.42935 | 0.59551 | 4.79750 |
| −0.41836 | 0.58706 | 4.79750 |
| −0.40567 | 0.57649 | 4.79750 |
| −0.39126 | 0.56363 | 4.79750 |
| −0.37462 | 0.54800 | 4.79750 |
| −0.35581 | 0.52955 | 4.79750 |
| −0.33505 | 0.50810 | 4.79750 |
| −0.31232 | 0.48368 | 4.79750 |
| −0.28738 | 0.45650 | 4.79750 |
| −0.26024 | 0.42658 | 4.79750 |
| −0.23221 | 0.39510 | 4.79750 |
| −0.20322 | 0.36214 | 4.79750 |
| −0.17320 | 0.32773 | 4.79750 |
| −0.14215 | 0.29189 | 4.79750 |

TABLE 1-continued

| X | Y | Z |
|---|---|---|
| −0.11007 | 0.25463 | 4.79750 |
| −0.07692 | 0.21596 | 4.79750 |
| −0.04269 | 0.17590 | 4.79750 |
| −0.00852 | 0.13580 | 4.79750 |
| 0.02554 | 0.09561 | 4.79750 |
| 0.05942 | 0.05527 | 4.79750 |
| 0.09309 | 0.01474 | 4.79750 |
| 0.12647 | −0.02603 | 4.79750 |
| 0.15946 | −0.06710 | 4.79750 |
| 0.19224 | −0.10836 | 4.79750 |
| 0.22495 | −0.14966 | 4.79750 |
| 0.25770 | −0.19093 | 4.79750 |
| 0.29055 | −0.23213 | 4.79750 |
| 0.32357 | −0.27319 | 4.79750 |
| 0.35573 | −0.31268 | 4.79750 |
| 0.38708 | −0.35057 | 4.79750 |
| 0.41764 | −0.38683 | 4.79750 |
| 0.44739 | −0.42144 | 4.79750 |
| 0.47637 | −0.45438 | 4.79750 |
| 0.50459 | −0.48564 | 4.79750 |
| 0.53207 | −0.51520 | 4.79750 |
| 0.55877 | −0.54310 | 4.79750 |
| 0.58337 | −0.56815 | 4.79750 |
| 0.60592 | −0.59033 | 4.79750 |
| 0.62643 | −0.60958 | 4.79750 |
| 0.64617 | −0.62707 | 4.79750 |
| 0.66361 | −0.64184 | 4.79750 |
| 0.67715 | −0.65305 | 4.79750 |
| 0.68803 | −0.66197 | 4.79750 |
| 0.69531 | −0.66948 | 4.79750 |
| 0.69723 | −0.67710 | 4.79750 |
| 0.69661 | −0.68144 | 4.79750 |
| 0.69561 | −0.68407 | 4.79750 |
| 0.69494 | −0.68530 | 4.79750 |
| 0.69457 | −0.68590 | 4.79750 |
| 0.69437 | −0.68619 | 4.79750 |
| 0.67336 | −0.69915 | 5.50000 |
| 0.67290 | −0.69971 | 5.50000 |
| 0.67193 | −0.70077 | 5.50000 |
| 0.66970 | −0.70259 | 5.50000 |
| 0.66565 | −0.70451 | 5.50000 |
| 0.65763 | −0.70481 | 5.50000 |
| 0.64805 | −0.69991 | 5.50000 |
| 0.63580 | −0.69224 | 5.50000 |
| 0.62054 | −0.68259 | 5.50000 |
| 0.60069 | −0.67005 | 5.50000 |
| 0.57763 | −0.65583 | 5.50000 |
| 0.55283 | −0.64099 | 5.50000 |
| 0.52484 | −0.62445 | 5.50000 |
| 0.49380 | −0.60598 | 5.50000 |
| 0.45980 | −0.58542 | 5.50000 |
| 0.42441 | −0.56367 | 5.50000 |
| 0.38768 | −0.54066 | 5.50000 |
| 0.34970 | −0.51625 | 5.50000 |
| 0.31055 | −0.49033 | 5.50000 |
| 0.27034 | −0.46277 | 5.50000 |
| 0.22917 | −0.43345 | 5.50000 |
| 0.18714 | −0.40223 | 5.50000 |
| 0.14439 | −0.36896 | 5.50000 |
| 0.10250 | −0.33471 | 5.50000 |
| 0.06153 | −0.29942 | 5.50000 |
| 0.02154 | −0.26305 | 5.50000 |
| −0.01740 | −0.22551 | 5.50000 |
| −0.05517 | −0.18667 | 5.50000 |
| −0.09149 | −0.14664 | 5.50000 |
| −0.12634 | −0.10564 | 5.50000 |
| −0.15980 | −0.06372 | 5.50000 |
| −0.19190 | −0.02089 | 5.50000 |
| −0.22272 | 0.02278 | 5.50000 |
| −0.25232 | 0.06726 | 5.50000 |
| −0.27977 | 0.11103 | 5.50000 |
| −0.30514 | 0.15405 | 5.50000 |
| −0.32853 | 0.19624 | 5.50000 |
| −0.35003 | 0.23754 | 5.50000 |
| −0.36972 | 0.27791 | 5.50000 |
| −0.38763 | 0.31733 | 5.50000 |
| −0.40364 | 0.35563 | 5.50000 |
| −0.41729 | 0.39094 | 5.50000 |

TABLE 1-continued

| X | Y | Z |
|---|---|---|
| −0.42885 | 0.42314 | 5.50000 |
| −0.43822 | 0.45229 | 5.50000 |
| −0.44545 | 0.47835 | 5.50000 |
| −0.45093 | 0.50120 | 5.50000 |
| −0.45492 | 0.52074 | 5.50000 |
| −0.45763 | 0.53756 | 5.50000 |
| −0.45928 | 0.55176 | 5.50000 |
| −0.45987 | 0.56353 | 5.50000 |
| −0.45910 | 0.57303 | 5.50000 |
| −0.45729 | 0.58011 | 5.50000 |
| −0.45496 | 0.58512 | 5.50000 |
| −0.45226 | 0.58884 | 5.50000 |
| −0.44954 | 0.59132 | 5.50000 |
| −0.44720 | 0.59279 | 5.50000 |
| −0.44480 | 0.59382 | 5.50000 |
| −0.44144 | 0.59463 | 5.50000 |
| −0.43711 | 0.59483 | 5.50000 |
| −0.43200 | 0.59409 | 5.50000 |
| −0.42545 | 0.59189 | 5.50000 |
| −0.41754 | 0.58767 | 5.50000 |
| −0.40842 | 0.58114 | 5.50000 |
| −0.39794 | 0.57242 | 5.50000 |
| −0.38585 | 0.56159 | 5.50000 |
| −0.37213 | 0.54846 | 5.50000 |
| −0.35630 | 0.53254 | 5.50000 |
| −0.33842 | 0.51380 | 5.50000 |
| −0.31871 | 0.49206 | 5.50000 |
| −0.29714 | 0.46734 | 5.50000 |
| −0.27345 | 0.43989 | 5.50000 |
| −0.24764 | 0.40971 | 5.50000 |
| −0.22096 | 0.37800 | 5.50000 |
| −0.19336 | 0.34482 | 5.50000 |
| −0.16475 | 0.31022 | 5.50000 |
| −0.13514 | 0.27421 | 5.50000 |
| −0.10451 | 0.23681 | 5.50000 |
| −0.07283 | 0.19804 | 5.50000 |
| −0.04007 | 0.15792 | 5.50000 |
| −0.00733 | 0.11778 | 5.50000 |
| 0.02534 | 0.07758 | 5.50000 |
| 0.05786 | 0.03727 | 5.50000 |
| 0.09021 | −0.00319 | 5.50000 |
| 0.12229 | −0.04386 | 5.50000 |
| 0.15403 | −0.08480 | 5.50000 |
| 0.18560 | −0.12587 | 5.50000 |
| 0.21715 | −0.16695 | 5.50000 |
| 0.24876 | −0.20799 | 5.50000 |
| 0.28052 | −0.24892 | 5.50000 |
| 0.31249 | −0.28967 | 5.50000 |
| 0.34368 | −0.32885 | 5.50000 |
| 0.37411 | −0.36643 | 5.50000 |
| 0.40379 | −0.40238 | 5.50000 |
| 0.43273 | −0.43666 | 5.50000 |
| 0.46095 | −0.46929 | 5.50000 |
| 0.48844 | −0.50025 | 5.50000 |
| 0.51523 | −0.52952 | 5.50000 |
| 0.54127 | −0.55714 | 5.50000 |
| 0.56528 | −0.58195 | 5.50000 |
| 0.58728 | −0.60392 | 5.50000 |
| 0.60729 | −0.62301 | 5.50000 |
| 0.62656 | −0.64036 | 5.50000 |
| 0.64359 | −0.65501 | 5.50000 |
| 0.65681 | −0.66616 | 5.50000 |
| 0.66741 | −0.67503 | 5.50000 |
| 0.67458 | −0.68244 | 5.50000 |
| 0.67648 | −0.68994 | 5.50000 |
| 0.67586 | −0.69421 | 5.50000 |
| 0.67483 | −0.69679 | 5.50000 |
| 0.67416 | −0.69799 | 5.50000 |
| 0.67377 | −0.69857 | 5.50000 |
| 0.67357 | −0.69886 | 5.50000 |

It will also be appreciated that the exemplary stator compressor vane airfoil(s) disclosed in the above TABLE 1 may be scaled up or down geometrically for use in other similar compressor designs. Consequently, the coordinate values set forth in the TABLE 1 may be scaled upwardly or downwardly such that the airfoil profile shape remains unchanged. A scaled version of the coordinates in TABLE 1 would be represented by X, Y and Z coordinate values of TABLE 1 multiplied or divided by a constant.

While various embodiments are described herein, it will be appreciated from the specification that various combinations of elements, variations, or improvements therein may be made by those skilled in the art, and are within the scope of the invention.

What is claimed is:

1. An article of manufacture, the article having a nominal profile substantially in accordance with Cartesian coordinate values of X, Y and Z set forth in TABLE 1, and wherein X and Y are distances in inches which, when connected by smooth continuing arcs, define airfoil profile sections at each distance Z in inches, the profile sections at the Z distances being joined smoothly with one another to form a complete airfoil shape.

2. An article of manufacture according to claim 1, wherein the article comprises an airfoil.

3. An article of manufacture according to claim 2, wherein said article shape lies in an envelope within ±0.160 inches in a direction normal to any article surface location.

4. An article of manufacture according to claim 1, wherein the article comprises a stator compressor vane.

5. A compressor comprising a compressor case having a plurality of stator compressor vane, each of said stator compressor vane including an airfoil having an airfoil shape, said airfoil having a nominal profile substantially in accordance with Cartesian coordinate values of X, Y and Z set forth in TABLE 1, wherein X and Y are distances in inches which, when connected by smooth continuing arcs, define the airfoil profile sections at each distance Z in inches, the profile sections at the Z distances being joined smoothly with one another to form a complete airfoil shape.

6. A compressor comprising a compressor case having a plurality of stator compressor vane, each of said stator compressor vane including an airfoil having an uncoated nominal airfoil profile substantially in accordance with Cartesian coordinate values of X, Y and Z set forth in a TABLE 1, wherein X and Y are distances in inches which, when connected by smooth continuing arcs, define airfoil profile sections at each distance Z in inches, the profile sections at the Z distances being joined smoothly with one another to form a complete airfoil shape, the X and Y distances being scalable as a function of the same constant or number to provide a scaled-up or scaled-down stator compressor vane airfoil.

7. A compressor according to claim 6, wherein the compressor case comprises a fourteenth stage of the compressor.

8. A compressor according to claim 6, wherein said airfoil shape lies in an envelope within ±0.160 inches in a direction normal to any airfoil surface location.

* * * * *